US008001740B2

(12) United States Patent
Smith et al.

(10) Patent No.: US 8,001,740 B2
(45) Date of Patent: Aug. 23, 2011

(54) BALLISTIC AND FORCED ENTRY RESISTANT CONSTRUCTION

(76) Inventors: Jeffery L. Smith, Jacksonville Beach, FL (US); Keith Eustace, Blenn Daw, MD (US)

( * ) Notice: Subject to any disclaimer, the term of this patent is extended or adjusted under 35 U.S.C. 154(b) by 121 days.

(21) Appl. No.: 12/476,254

(22) Filed: Jun. 1, 2009

(65) Prior Publication Data

US 2009/0293420 A1 Dec. 3, 2009

Related U.S. Application Data

(60) Provisional application No. 61/057,200, filed on May 30, 2008.

(51) Int. Cl.
*E04B 2/30* (2006.01)

(52) U.S. Cl. ..... 52/483.1; 52/79.5; 52/106

(58) Field of Classification Search ..... 52/483.1, 52/782.1, 783.1, 787.1, 790.1, 792.1, 795.1, 52/79.1, 79.5, 106, 281, 282.1
See application file for complete search history.

(56) References Cited

U.S. PATENT DOCUMENTS

| | | | | |
|---|---|---|---|---|
| 728,471 | A | 5/1903 | Kulhanek | |
| 4,625,659 | A | 12/1986 | Saelzer | |
| 5,050,363 | A | 9/1991 | Fornell | |
| 5,353,557 | A | 10/1994 | Lerner et al. | |
| 5,386,788 | A * | 2/1995 | Linker et al. | 109/58 |
| 5,402,608 | A | 4/1995 | Chu | |
| 5,528,871 | A | 6/1996 | Brodeur | |
| 5,737,895 | A | 4/1998 | Perrin | |
| 5,768,845 | A * | 6/1998 | Beaulieu et al. | 52/585.1 |
| 5,822,936 | A | 10/1998 | Bateman | |
| 6,070,372 | A | 6/2000 | Norman et al. | |
| 6,415,558 | B1 * | 7/2002 | Cherry | 52/79.1 |
| 6,438,906 | B1 | 8/2002 | Komarowski et al. | |
| 6,711,860 | B2 | 3/2004 | Fleishman | |
| 6,786,009 | B1 * | 9/2004 | McGunn et al. | 52/36.2 |
| 6,862,847 | B2 * | 3/2005 | Bigelow | 52/79.1 |

(Continued)

FOREIGN PATENT DOCUMENTS

| | | |
|---|---|---|
| FR | 2687711 | 8/1993 |
| JP | 2006305254 | 11/2006 |

OTHER PUBLICATIONS

"iFortress", website: http://www.ifortress.com/products/index.html; 2 pages; printed Apr. 12, 2008.

(Continued)

*Primary Examiner* — Brian E Glessner
*Assistant Examiner* — Rodney Mintz
(74) *Attorney, Agent, or Firm* — Christopher Wood; Daniel Eisenberg; Premier Law Group, PLLC

(57) ABSTRACT

A ballistic and forced entry resistant construction in which a sidewall is made up of a plurality of vertical columns, at least one perimeter floor sill section, at least one perimeter ceiling sill section, a plurality of bottom internal sleeves at spaced intervals extending upward from the perimeter floor sill section, a plurality of top internal sleeves at spaced intervals extending downward from the perimeter ceiling sill section, a plurality of upper outer panels, a plurality of lower outer panels, and a plurality of inner wall panels. A connecting tube is used to connect the upper and lower outer plates. The vertical columns are located between the bottom and top internal sleeves such that the sleeves fit inside the opposite ends of vertical columns and the upper and lower outer panels are located between vertical support columns.

1 Claim, 36 Drawing Sheets

U.S. PATENT DOCUMENTS

| | | | | |
|---|---|---|---|---|
| 6,938,381 | B1 | 9/2005 | Villa | |
| 6,983,567 | B2 | 1/2006 | Ciotti | |
| 7,017,311 | B2 | 3/2006 | Weiss | |
| 7,117,644 | B2 | 10/2006 | Dehart | |
| 7,178,297 | B2 | 2/2007 | Seavy | |
| 7,458,305 | B1 * | 12/2008 | Horlander et al. | 89/36.01 |
| 7,661,228 | B1 * | 2/2010 | Nolte et al. | 52/79.1 |
| 2003/0029101 | A1 * | 2/2003 | Lyons | 52/79.1 |
| 2004/0206015 | A1 * | 10/2004 | Greenboim | 52/79.1 |
| 2006/0101750 | A1 * | 5/2006 | Paquin | 52/309.12 |
| 2010/0115858 | A1 * | 5/2010 | Olsen | 52/79.1 |
| 2010/0293868 | A1 * | 11/2010 | Holzworth | 52/79.5 |

OTHER PUBLICATIONS

"iFortress—iGuard Armor Panel", PDF document downloaded from website: http://www.dancker.com/sw/swchannel/productcatalogcf_v2/internet/model.asp/ProductMasterID/282824/ParentID/211878/SWSESSIONID/plcchherspuuee; 1 page, printed Apr. 12, 2008.

"iGUARD Armor Panel and Modular iBUNKER Overview", website: http://www.ifortress.com/pdf/iBunker%20Product%20Overview%20v1.2.pdf 4 pages; see Figure 1 which discloses a rendering of the "Modular iBunker", and p. 4 recites in part: "Certified self contained, watertight, fire and thermal resistant, hermetically sealed, bullet resistant, blast tolerant, Faraday Cage, six-sided, modular enclosures", printed Apr. 12, 2008.

"Modular iBunker", website: http://www.dancker.com/SWAPPID/87/PCPAGE/212197; 1 page; printed Apr. 11, 2008.

"Modular iBunker #2", website: http://www.dancker.com/sw/swchannel/productcatalogcf_v2/internet/model.asp/ProductMasterID/282808/ParentID/212197/SWSESSIONID/plccspapurespa; 1 page, printed Apr. 12, 2008.

* cited by examiner

| TABLE | |
|---|---|
| Part # | Description |
| 100 | ballistic and forced entry resistant room |
| 120 | front end |
| 140 | rear end |
| 160 | first side wall |
| 180 | second side wall |
| 200 | floor |
| 220 | ceiling |
| 240 | doorway or door opening |
| 260 | non-rectangular floor plan |
| 280 | door |
| 300 | third sidewall |
| 320 | vertical support columns 320 |
| 320c | corner vertical support columns 320c |
| 340 | upper outer panel 340 |
| 360 | lower outer panel 360 |
| 380 | inner wall panel 380 |
| 400 | interior ballistic stop 400 |
| 420 | four sided plate 420 of upper outer wall panel 340 |
| 430 | bottom edge 430 of plate 420 |
| 435 | top edge 435 of plate 420 |
| 437<br>439 | opposite first and second vertical edges 437 and 439 of plate 420 |
| 440 | interior face 440 of upper outer wall panel 340 |

FIG. 28A

| TABLE | |
|---|---|
| Part # | Description |
| 444 | exterior face 444 of upper outer wall panel 340 |
| 450 | optional stiffening bar 450 |
| 460a<br>460b<br>460c<br>460d | L-brackets 460a, 460b, 460c and 460d |
| 480 | four sided plate 480 of lower outer wall panel 360 |
| 500 | interior face 500 of lower outer wall panel 360 |
| 510 | exterior face 510 of lower outer wall panel 360 |
| 520a<br>520b<br>520c | L-brackets 520a, 520b, and 520c |
| 540 | optional stiffening bar 540 |
| 560 | connecting tube 560 |
| 570 | connecting tube 560 defines top side 570 |
| 580 | top horizontal edge 580 of plate 480 |
| 584 | bottom horizontal edge 584 of plate 480 |
| 586 | vertical edge 586 of plate 480 |
| 588 | vertical edge 588 of plate 480 |
| 600<br>620 | inner face 600 and an outer face 620 of inner wall panel 380 |

FIG. 28B

| TABLE | |
|---|---|
| Part # | Description |
| 640<br>660 | opposite facing vertical sides 640 and 660 of inner wall panel 380 |
| 680 | top and bottom edges 680 and 700 of inner wall panel 380 |
| 720 | optional recesses 720 |
| 740 | bottom floor panel 740 |
| 745 | bottom floor panel 740 defines inner and outer faces 745 and 750 |
| 750 | bottom floor panel 740 defines inner and outer faces 745 and 750 |
| 760 | perimeter floor sill sections 760 |
| 770 | upper surface 770 of floor sill section 760 |
| 780 | bottom internal sleeve 780 |
| 780c | bottom internal corner sleeve 780c |
| 800 | perimeter sill sections 760 define an inner side surface 800 |
| 820 | short floor sections 820 and transverse floor sections 840 |
| 840 | short floor sections 820 and transverse floor sections 840 |
| 860 | floor sheets 860 |

*FIG. 28C*

| TABLE | |
|---|---|
| Part # | Description |
| 640<br>660 | opposite facing vertical sides 640 and 660 of inner wall panel 380 |
| 680 | top and bottom edges 680 and 700 of inner wall panel 380 |
| 720 | optional recesses 720 |
| 740 | bottom floor panel 740 |
| 745 | bottom floor panel 740 defines inner and outer faces 745 and 750 |
| 750 | bottom floor panel 740 defines inner and outer faces 745 and 750 |
| 760 | perimeter floor sill sections 760 |
| 770 | upper surface 770 of floor sill section 760 |
| 780 | bottom internal sleeve 780 |
| 780c | bottom internal corner sleeve 780c |
| 800 | perimeter sill sections 760 define an inner side surface 800 |
| 820 | short floor sections 820 and transverse floor sections 840 |
| 840 | short floor sections 820 and transverse floor sections 840 |
| 860 | floor sheets 860 |
| 880 | fasteners bolts 880 |
| 900 | perimeter ceiling sill sections 900 |
| 920 | lower surface 920 of ceiling sill section 900 |
| 940 | top internal sleeve 940 |
| 940c | top internal corner sleeve 940c |
| 960 | short length L-bracket 960 |
| 980 | over-door outer panel 980 |
| 1000 | outer front end panel 1000 |
| 1020 | inner front end panel 1020 |
| 1040 | temporary support 1040 |

*FIG. 28D*

BALLISTIC AND FORCED ENTRY RESISTANT CONSTRUCTION

CROSS-REFERENCE TO RELATED APPLICATIONS

This application claims the benefit of priority from U.S. Provisional Patent Application Ser. No. 61/057,200 (filed May 30, 2008). The entire content of Provisional Patent Application Ser. No. 61/057,200 is explicitly incorporated herein in its entirety by reference.

STATEMENT REGARDING FEDERALLY SPONSORED RESEARCH OR DEVELOPMENT

Not Applicable.

FIELD OF THE INVENTION

This invention relates generally to ballistic and forced entry resistant construction.

BACKGROUND OF THE INVENTION

Ballistic resistant constructions such as, but not limited to, a sentry station or bunker are often rendered ballistic resistant by means of heavy construction materials such as bags of sand, concrete barriers and thick concrete blast resistant walls. Sometimes sand and concrete may not be readily available. There is therefore a need for a method of ballistic resistant construction that takes advantage of modular construction and efficient use of materials.

There is also a need for ballistic resistant rooms and the like for erection inside buildings without requiring heavy lifting gear such as cranes or the removal of building walls. More specifically, there is a need for ballistic structures that can be erected from parts which can be carried by one or two people through ordinary size interior doors of buildings to provide ballistic resistant rooms inside buildings without the use of on-site welding equipment.

BRIEF DESCRIPTION OF THE DRAWINGS

FIGS. 28A through 28D show a table of parts.

SUMMARY OF THE INVENTION

A ballistic and forced entry resistant construction.

DETAILED DESCRIPTION OF THE INVENTION

This invention is directed to an improved construction method and apparatus that provides a construction that is resistant to forced entry and ballistic impacts. Examples of constructions that can be made using the present invention include, but are not limited to, a guard booth, a panic room, a vault, and an arms-room.

The present invention offers considerable advantages over the prior art. For example, welding-equipment or specialist tools are not required during on-site installation. Heavy lifting equipment isn't required during installation because each part can be wheeled or carried through an average internal door, such as regular office doors and doors found in the average home.

Rooms or constructions of the present invention are generically referred to hereinafter as "room 100".

The terms "roof" and "ceiling" are regarded as equivalent terms hereinafter. The reason for the equivalency between the terms "roof" and "ceiling" is simply one of esthetics. For example, if the construction of the present invention is retrofitted inside a current structure such as an office or embassy building, then the "roof" of the present invention can be regarded by a reasonable person as either a roof or ceiling.

Figure 1A:
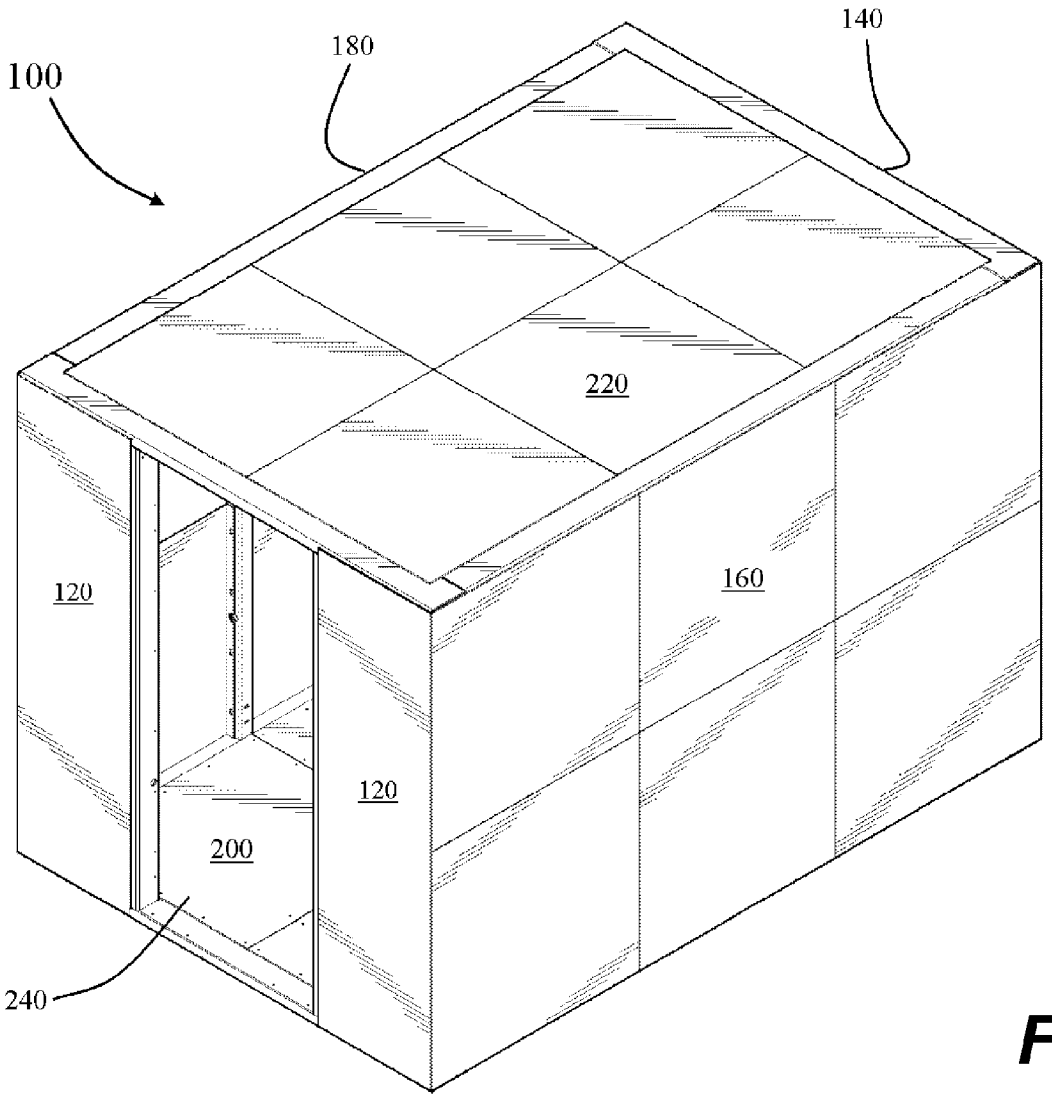
FIG. 1A shows a perspective view of a ballistic and forced entry resistant room according to the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary.

Figure 1B:
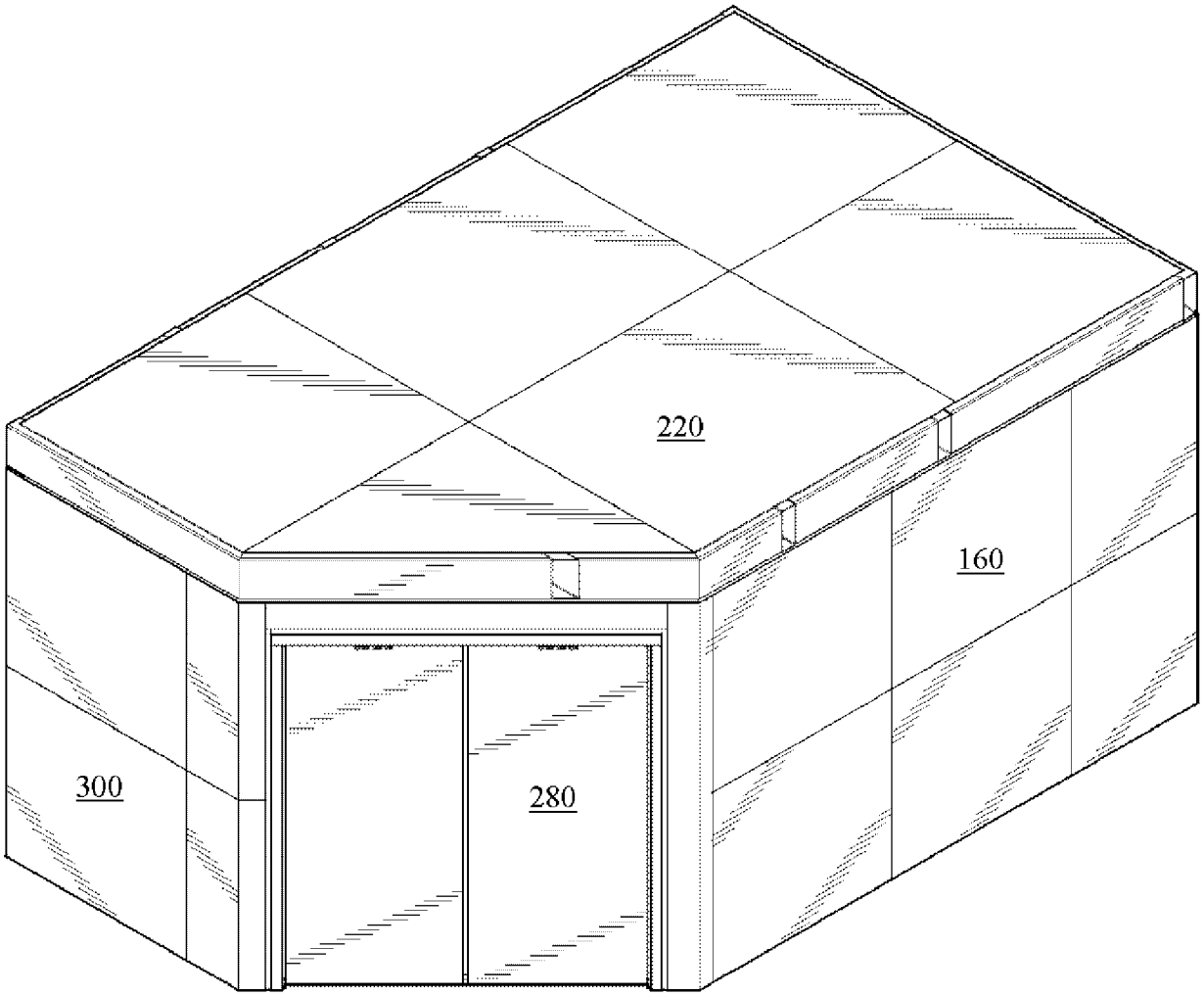
FIG. 1B shows a perspective view of a ballistic and forced entry resistant room according to the present invention.

It should be understood that the room 100 according to the invention can be made up of more than two sidewalls and can have a regular or non-regular polygonal footprint, e.g., a regular pentagonal footprint with five equal sized sidewalls and lack a traditional front and rear room ends. FIG. 1B shows a non-regular polygonal room according to the invention.

FIG. 1 shows a ballistic and forced entry resistant room 100 according to one embodiment of present invention. The room 100 shown in FIG. 1 is used as an exemplar to describe the invention. However, the room depicted in FIG. 1 is for illustrative purposes only and should not be read as limiting the present invention in any manner whatsoever.

Figure 1C:
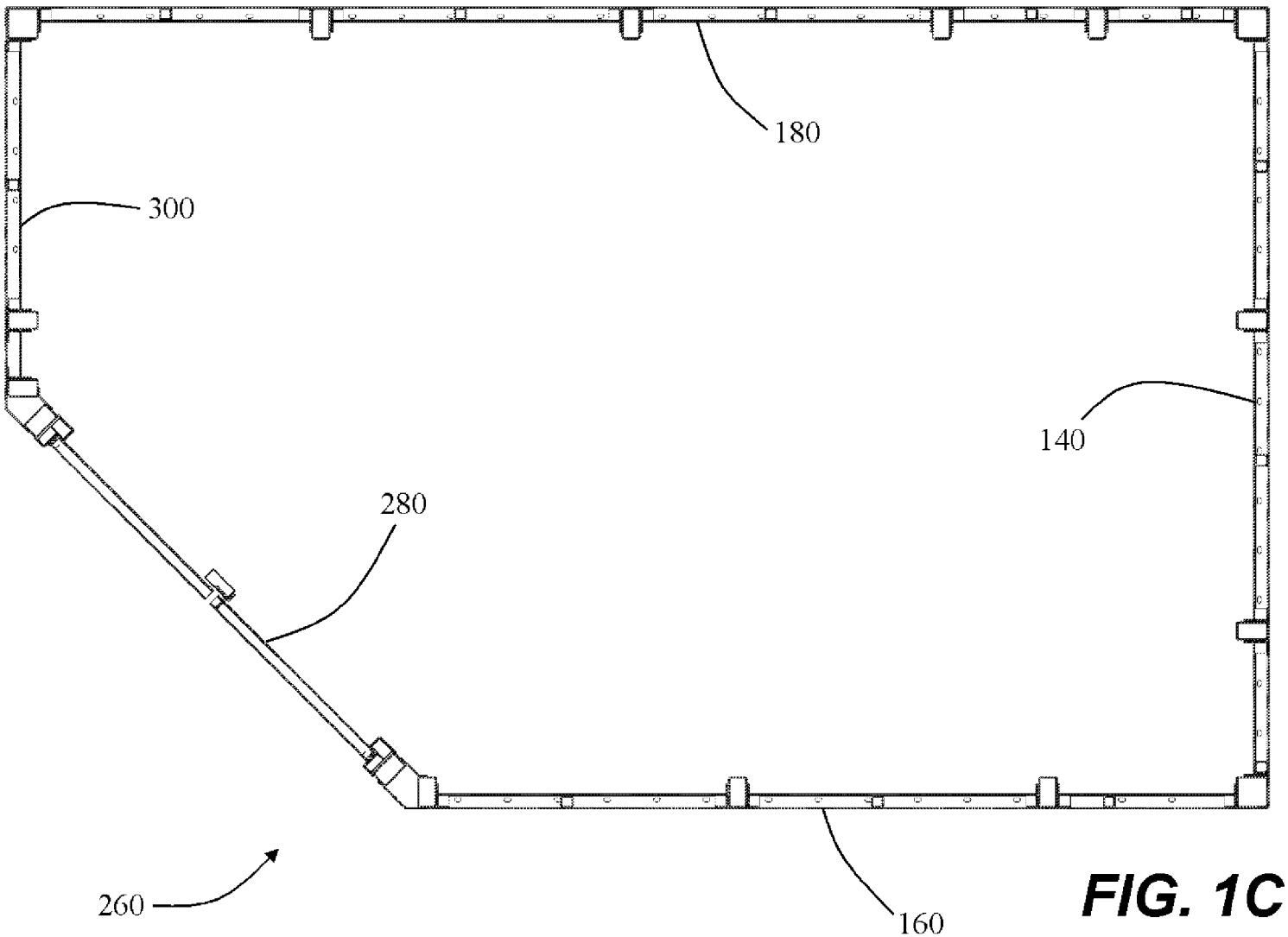
FIG. 1C shows a floor layout of the ballistic and forced entry resistant room of FIG. 1B.

The room 100 comprises front and rear ends 120 and 140, first and second side walls 160 and 180, a floor 200 and a ceiling 220. The front end 120 includes a doorway 240 to which a high security door (not shown) can be fitted. However, as stated above, it should be understood that the present invention is not limited to a particular size or overall shape of room. FIG. 1C, for example, shows a top planar view of a non-rectangular floor plan 260 according to the present invention. The non-rectangular floor plan 260 includes a door 280 and a third side wall 300.

The invention can be applied to a variety of floor plans. For example, a customer wanting the room 100 built into an existing room with a non-rectangular floor plan in an embassy building requiring a secure room; the floor plan for room 100 can be modified to meet that need without detracting from the spirit of the instant invention.

The first and second sidewalls 160 and 180, and the rear end 140 each comprises at least one vertical support column 320, at least one upper outer panel 340, at least one lower outer panel 360, at least one inner wall panel 380, and at least one interior ballistic stop 400.

Each upper outer wall panel 340 comprises a four sided plate 420. The plate 420 defines bottom and top edges 430 and 435, opposite first and second vertical edges 437 and 439, interior and exterior faces 440 and 444. The interior face 440 of plate 420 (and hence the interior face of upper outer wall panel 340) is fitted with four L-brackets 460*a*, 460*b*, 460*c* and 460*d* (the terms "L-bracket" and "channel" are regarded herein as equivalent terms).

The four L-brackets 460*a*, 460*b*, 460*c* and 460*d* are arranged in a rectangular pattern such as a square pattern on the interior face 440 of each upper outer wall panel 340. More specifically, an L-bracket is attached adjacent and parallel to the each side of the interior face 440. A series of drilled holes are located at predetermined points along each L-bracket 460*a*, 460*b*, 460*c* and 460*d*. An optional stiffening bar 450 is fitted to the interior face 440 of plate 420. Each four sided plate 420 can be made out of any suitable metal or metal alloy such as 0.25 inch American steel plate.

Each lower outer wall panel 360 comprises a four sided plate 480. The plate 480 (and hence panel 360) defines interior and exterior faces 500 and 510, opposite top and bottom edges 580 and 584, and opposite vertical edges 586 and 588. The interior face 500 of plate 480 (and hence the interior face of lower outer wall panel 360) is fitted with three L-brackets 520*a*, 520*b*, and 520*c*.

The three L-brackets 520*a*, 520*b*, and 520*c* are arranged in an open rectangular pattern such as an open square pattern on the interior face 500 of each lower outer wall panel 360. More specifically, an L-bracket is attached adjacent and parallel to each of sides 584, 586, and 588. A series of drilled holes are located at predetermined points along each L-bracket 520*a*, 520*b*, and 520*c*. An optional stiffening bar 540 can be fitted to the interior face 500 of plate 480. Each four sided plate 480 can be made out of any suitable metal alloy or metal such as 0.25 inch American steel plate.

It is preferred that the L-brackets of the upper and lower outer wall panels 340 and 360 are welded in the factory (i.e., not welded on site), and factory-welded to the interior faces 440 and 500 by means of continues welds rather than by spot-welding. Specifically, the L-brackets of the upper and lower outer wall panels 340 and 360 are welded along their entire length to the interior faces 440 and 500. Continuous welds help protect the room 100 from assailants using implements such as crowbars to gain access or peel back the panels 340 and 360. As will explained below, vertical L-brackets 460*a* and 460*c* are fastened to a supporting column 320; likewise vertical L-brackets 520*a* and 520*c* are fastened to a supporting column 320 to increase the resistance of the plates 420 and 480 of panels 340 and 360 to peel-back and/or forced entry.

A connecting tube 560 of overall rectangular cross-section is attached to the interior face 500 in such a manner that it overlaps and extends along a predetermined length of the top edge 580 of plate 480. The connecting tube 560 defines top side 570. The connecting tube 560 is used to align and join the bottom edge 430 of plate 420 to the top edge 580 of plate 480. During assembly of room 100 the top side 570 is attached by any suitable fastening means to the second L-bracket 460*b* of upper outer panel 340. Suitable fastening means include, but are not limited to, screws, bolts, rivets. Holes for screws can be drilled into the top side 570. Self-tapping screws can be used to attach the top side 570 of connecting tube 560 to L-bracket 460*b* thereby securing the upper and lower outer panels 340 and 360 to each other with bottom edge 430 of plate 420 and top horizontal edge 580 of plate 480 adjoining each other without requiring on-site welding.

It is preferred that the connecting tube 560 is continuously welded in the factory along its entire length to the interior face 500. Continuous welds are more effective at resisting assailants and attackers who use assailant tools such as a crowbar (also known as a pry bar or wrecking bar) in attempts to peel back the edges of the plates 420 and/or 480. The connecting tube 560 attached along its length to L-bracket 460*b* would render it very difficult for an assailant to pry apart edges 430 and 580 of plates 420 and 480 and gain access to the interior of room 100.

The first and second sidewalls 160 and 180, and rear end 140 of room 100 each comprise at least one inner wall panel 380. The inner wall panels 380 each define an inner face 600 and an outer face 620, first and second opposite facing vertical sides 640 and 660, and top and bottom edges 680 and 700. Each of the vertical sides 640 and 660 are bent lengthwise and inwards at a perpendicular angle from the inner face 600, i.e., upon assembly of room 100 the vertical sides 640 and 660 point towards the interior of room 100.

A series of drilled holes are located at predetermined points along each of the vertical sides 640 and 660. Optional recesses 720 are provided at predetermined locations along one or both vertical sides 640 and 660 to accommodate wiring (not shown). The inner panels 380 can be made out of any suitable metal or metal alloy such as 0.25 inch American steel plate.

The floor 200 comprises at least one bottom floor panel 740. In the preferred embodiment the bottom floor panels 740 are comprised of the same parts as the upper outer panel 340 with no requirement for the optional stiffening bar 450. The bottom floor panel 740 defines inner and outer faces 745 and 750.

Figure 2:
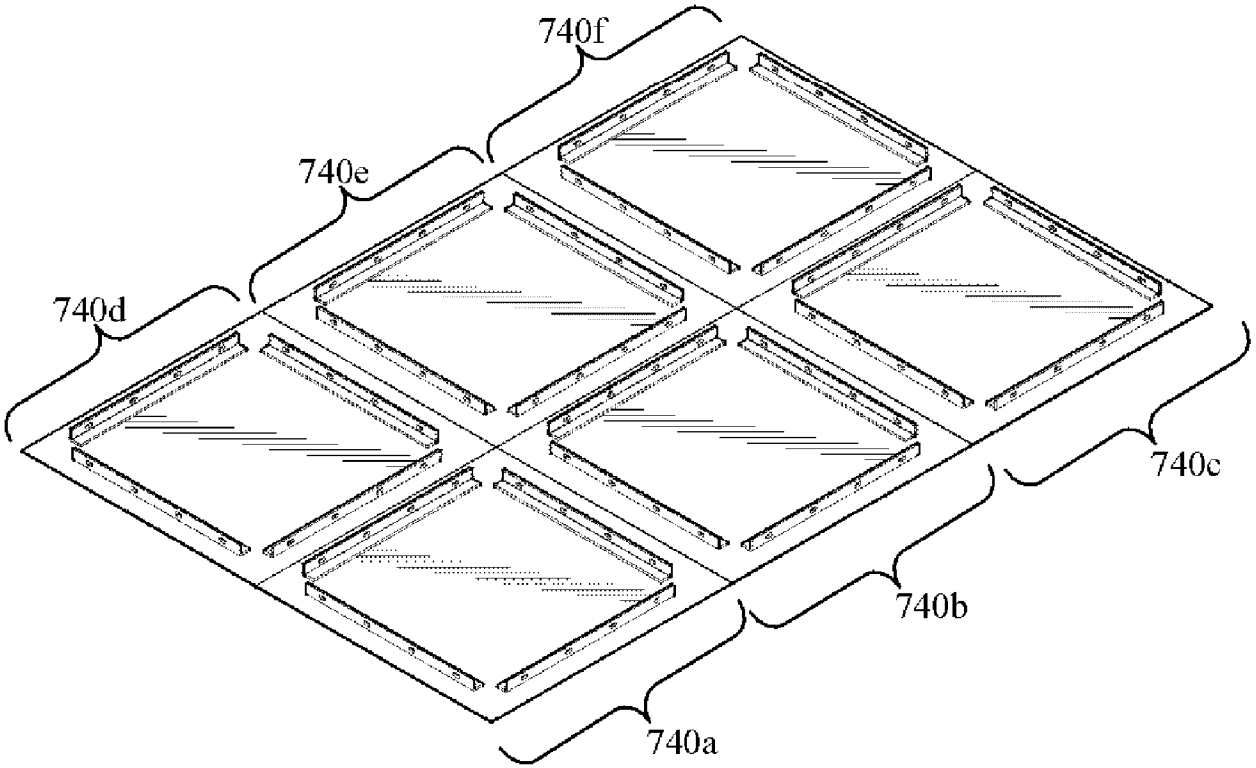
FIG. 2 shows a plurality of bottom floor panels according to the present invention.
Figure 3:
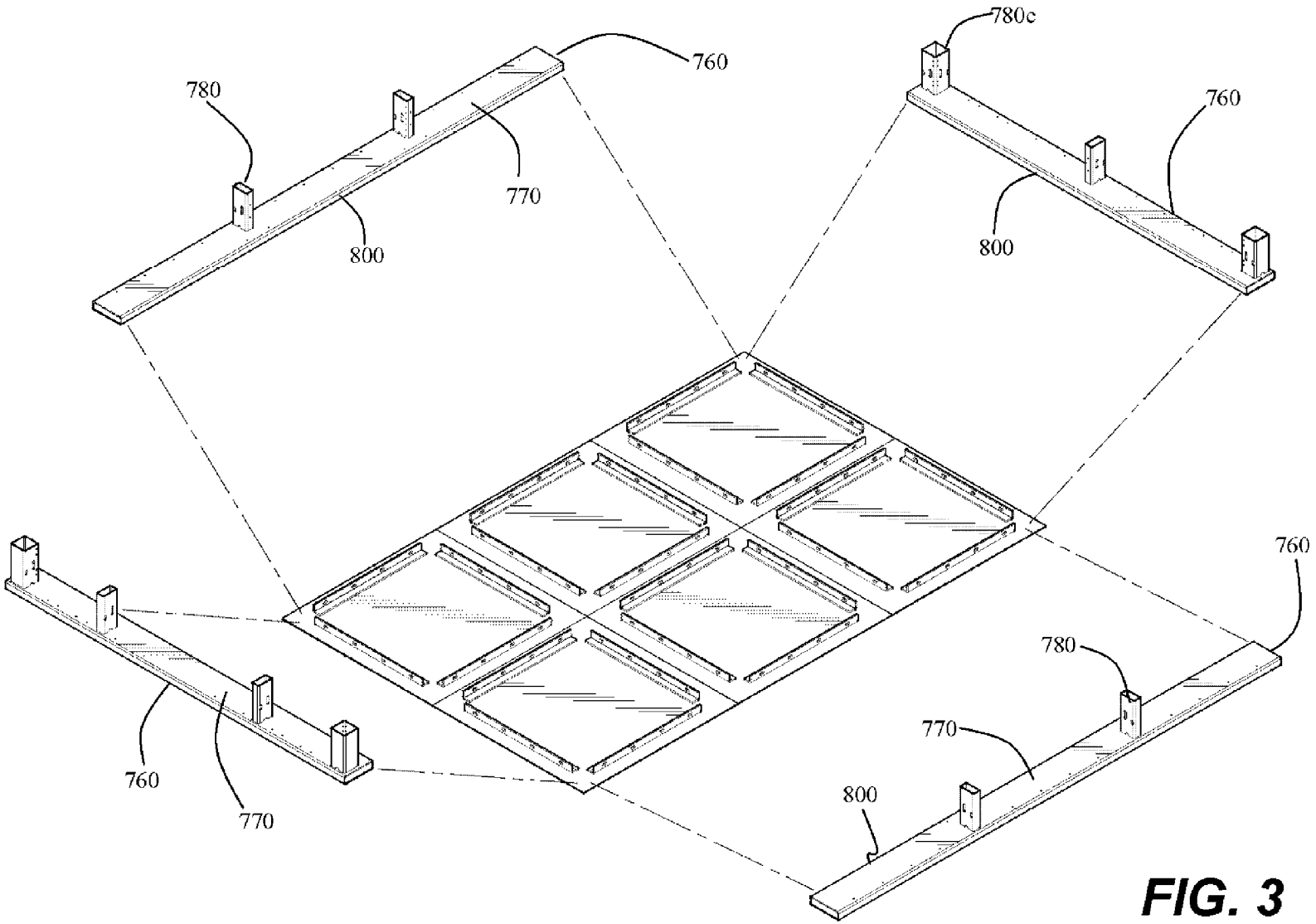
FIG. 3 shows a plurality of perimeter floor sill sections about to be fitted to the bottom floor panels of FIG. 2.
Figure 3A:
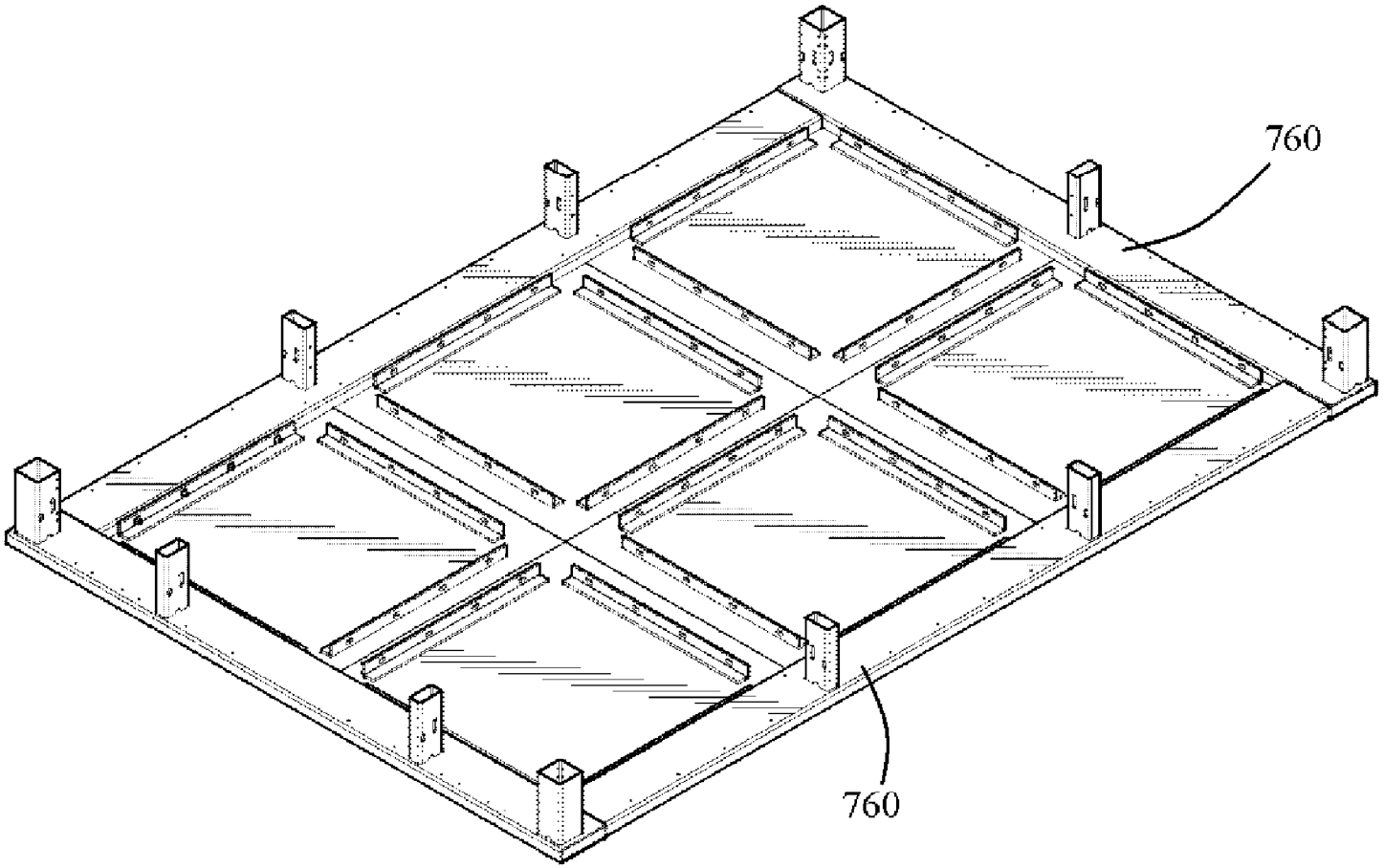
FIG. 3A shows the plurality of perimeter floor sill sections of FIG. 3 in place.
Figure 4:
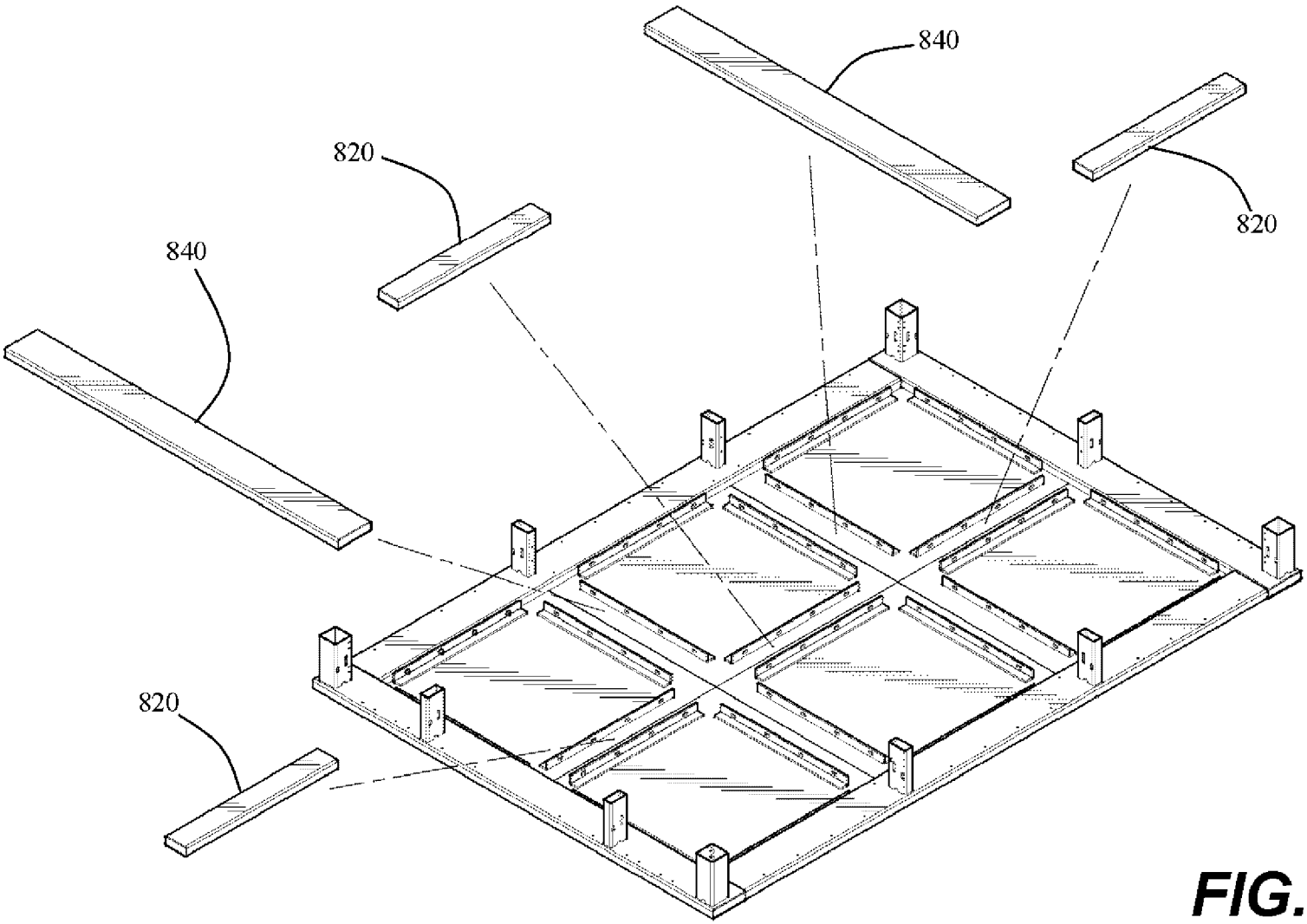
FIG. 4 shows a plurality of floor sections about to be fitted to the partly assembled flooring of FIG. 3A.
Figure 5:
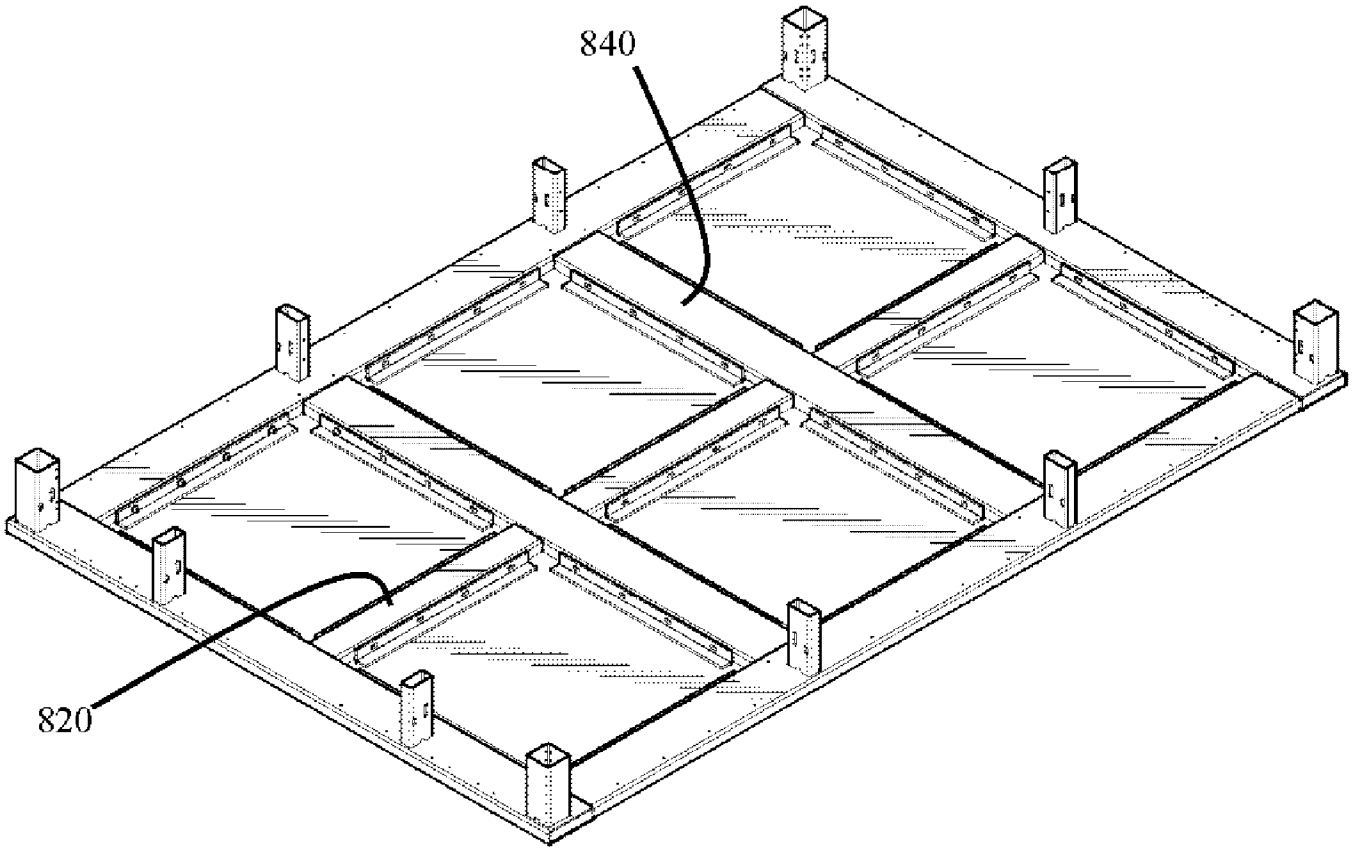
FIG. 5 shows the plurality of floor sections of FIG. 4 in place.
Figure 5A:
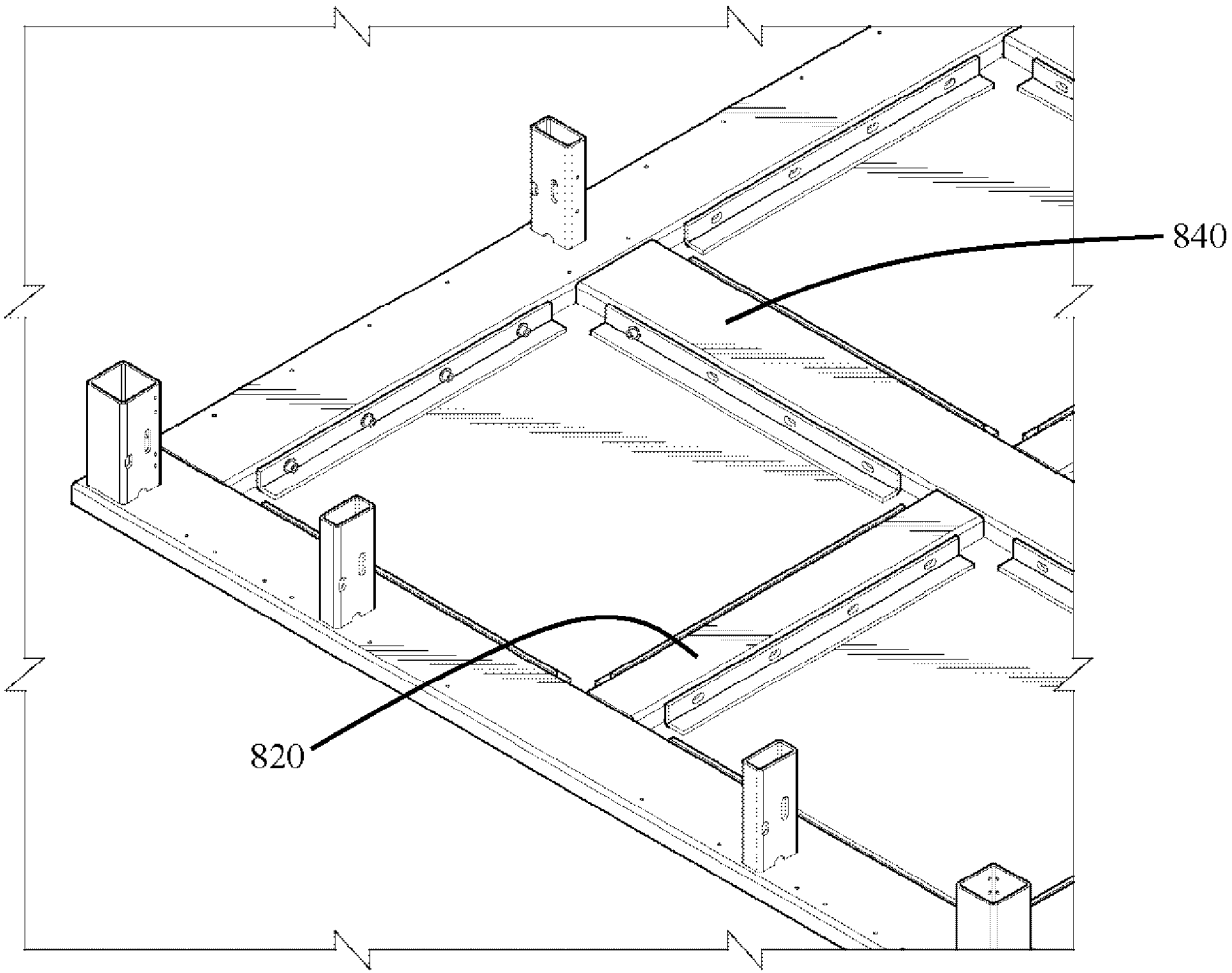
FIG. 5A shows a close up of the partly assembled flooring of FIG. 5.
Figure 6:
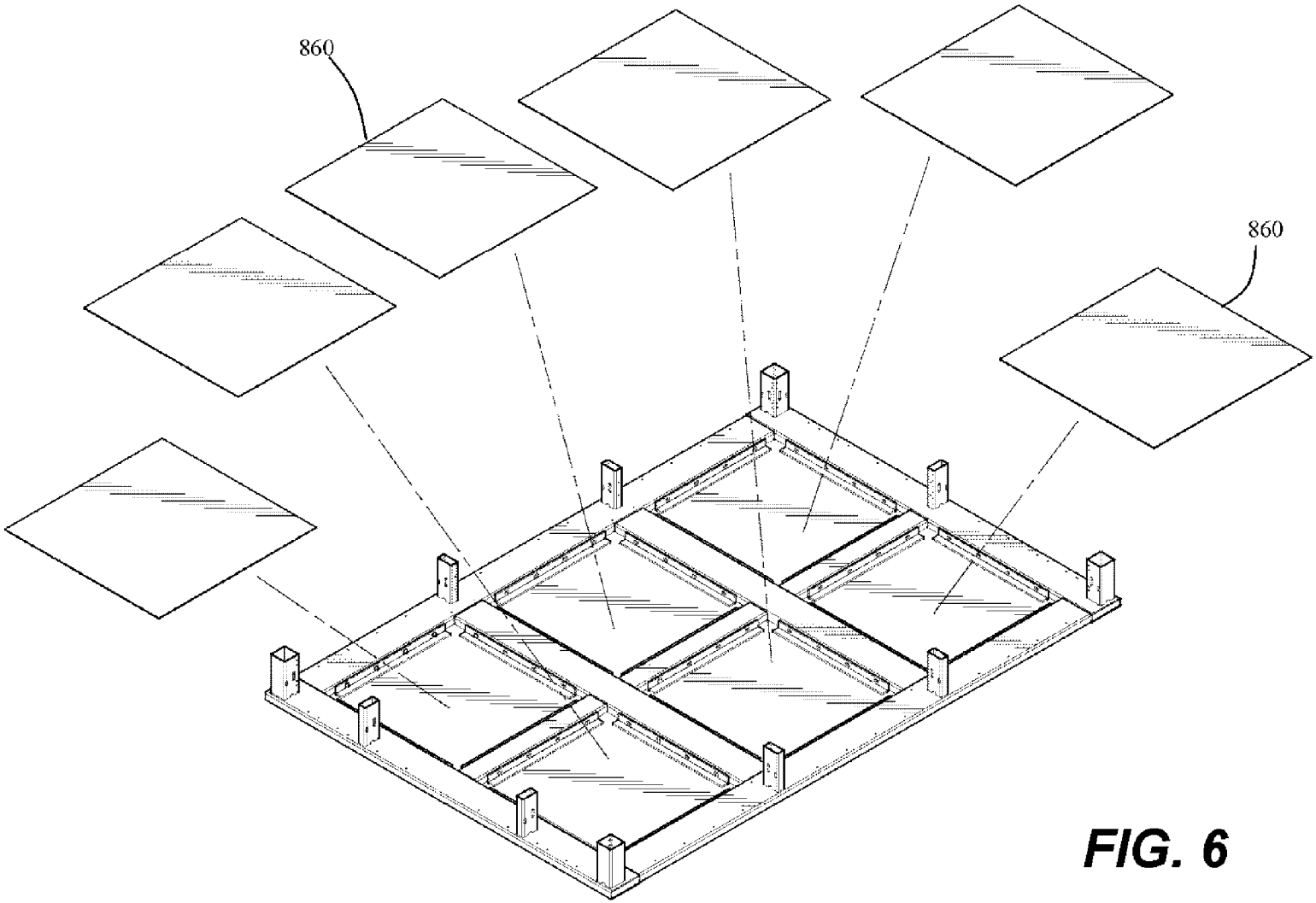
FIG. 6 shows a plurality of floor sheets about to be fitted to the partly assembled flooring of FIG. 5.
Figure 7:
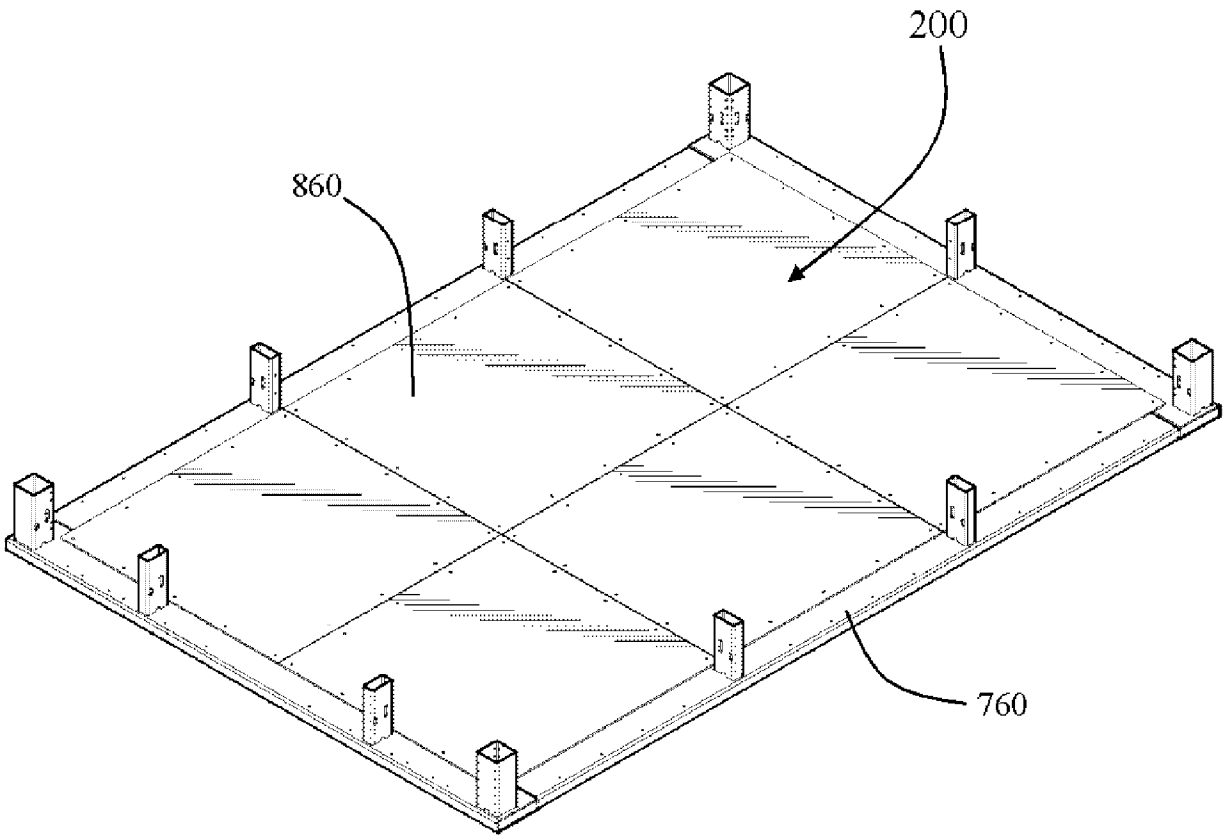
FIG. 7 shows the plurality of floor sheets of FIG. 6 in place.
Figure 8:
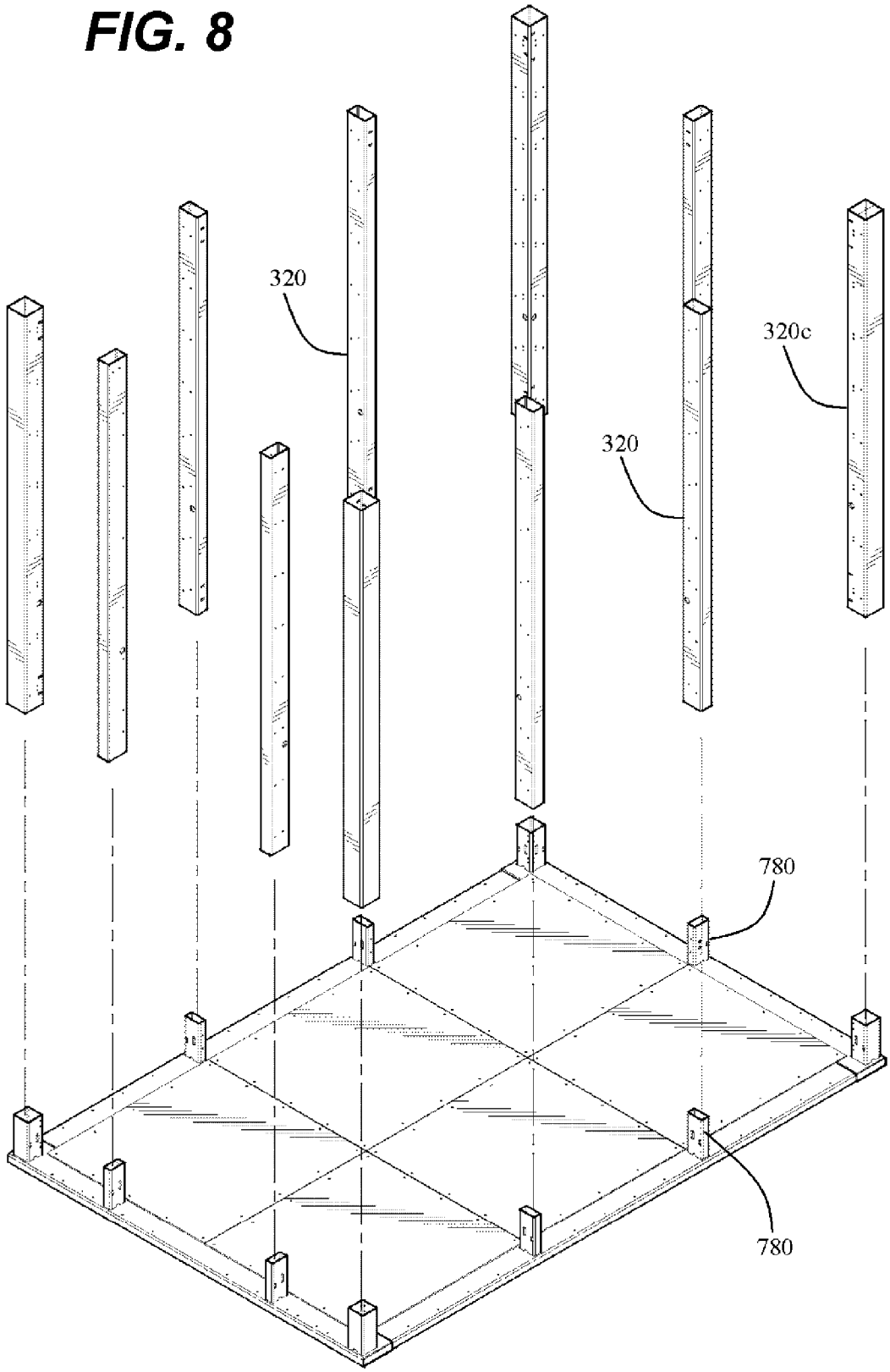
FIG. 8 shows a plurality of vertical support columns about to be fitted to the flooring of FIG. 7.
Figure 9:
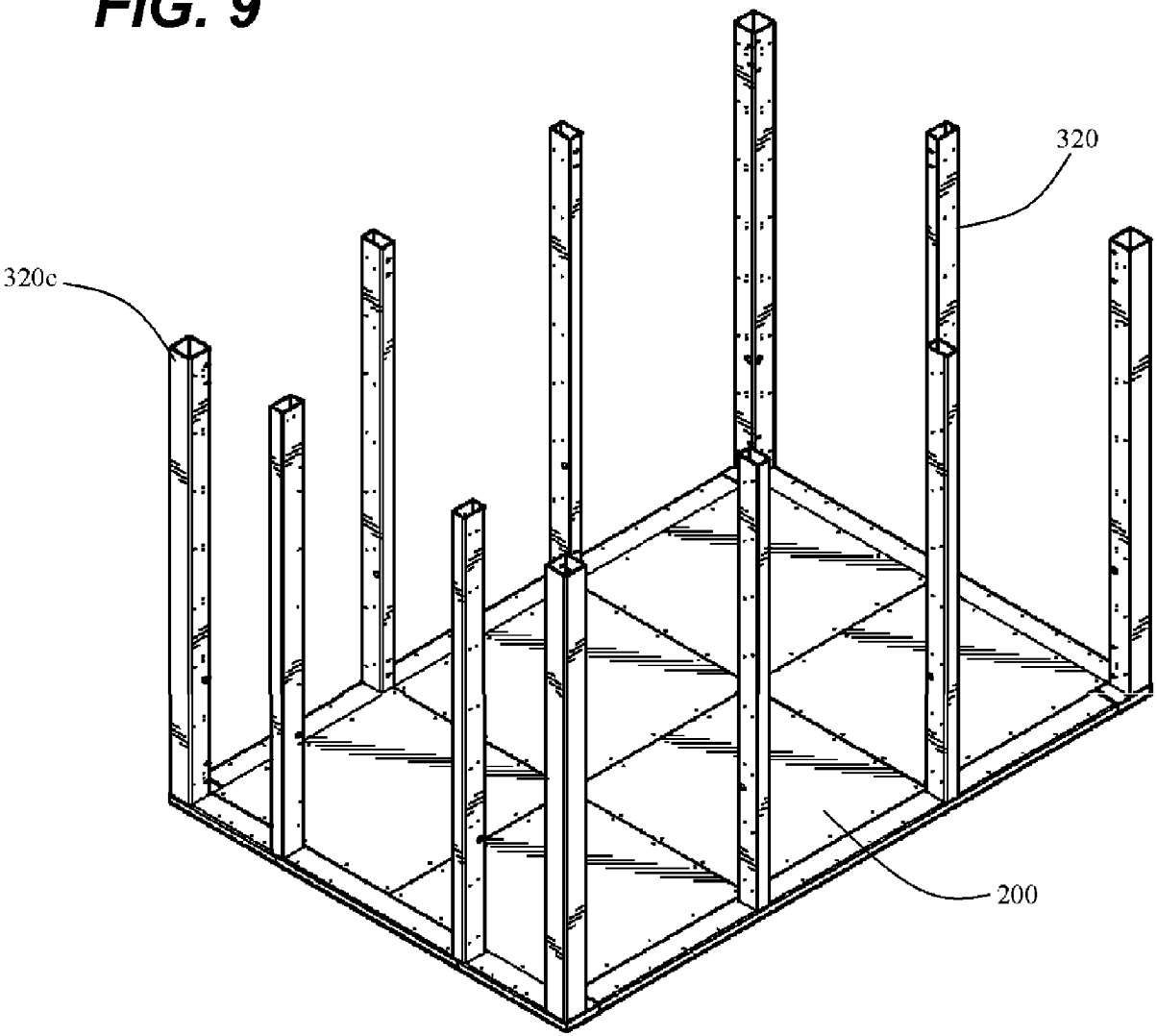
FIG. 9 shows the plurality of vertical support columns of FIG. 8 in place.
Figure 10:
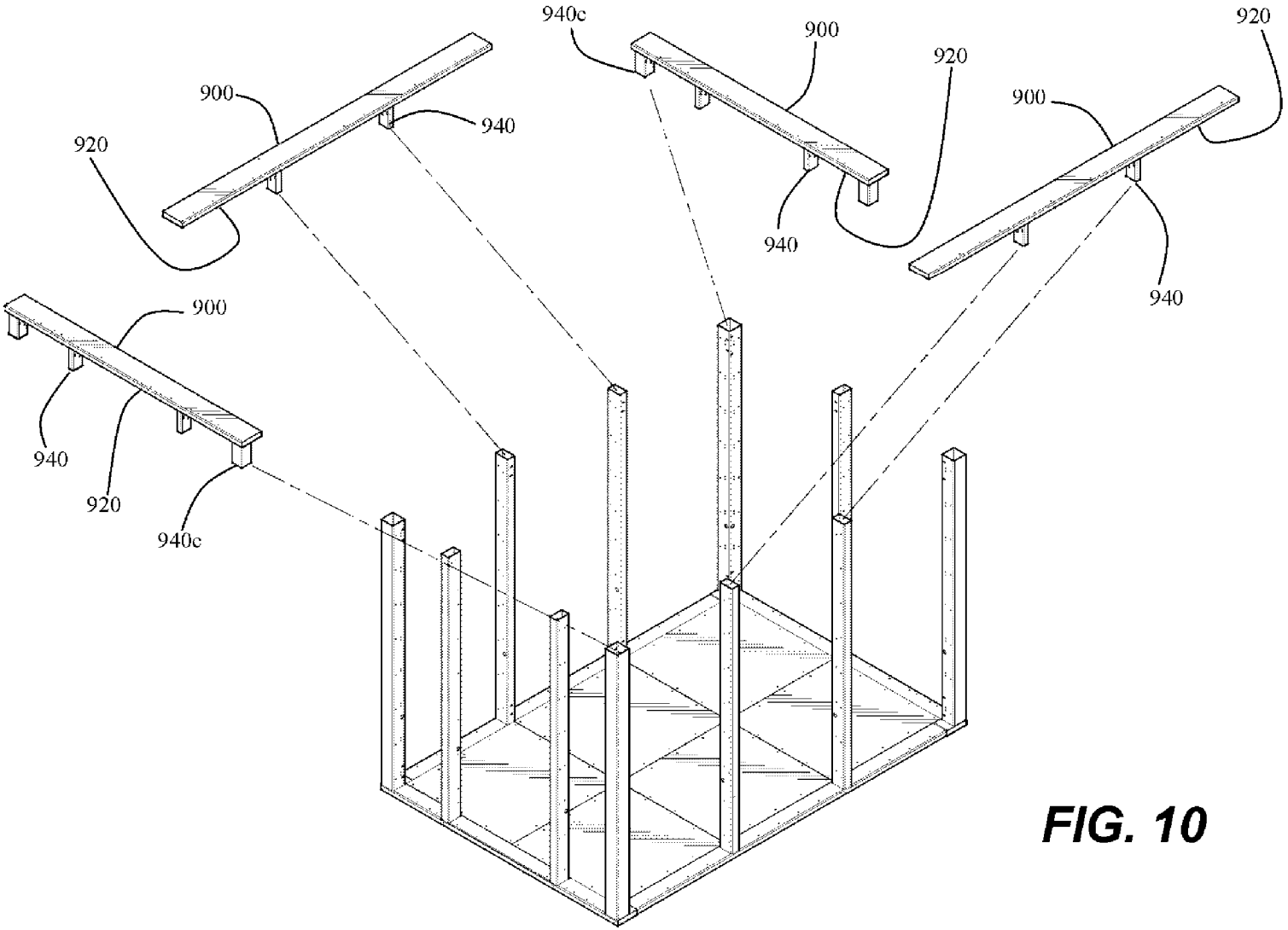
FIG. 10 shows a plurality of perimeter ceiling sill sections about to be fitted to the vertical support columns of FIG. 9.
Figure 11:
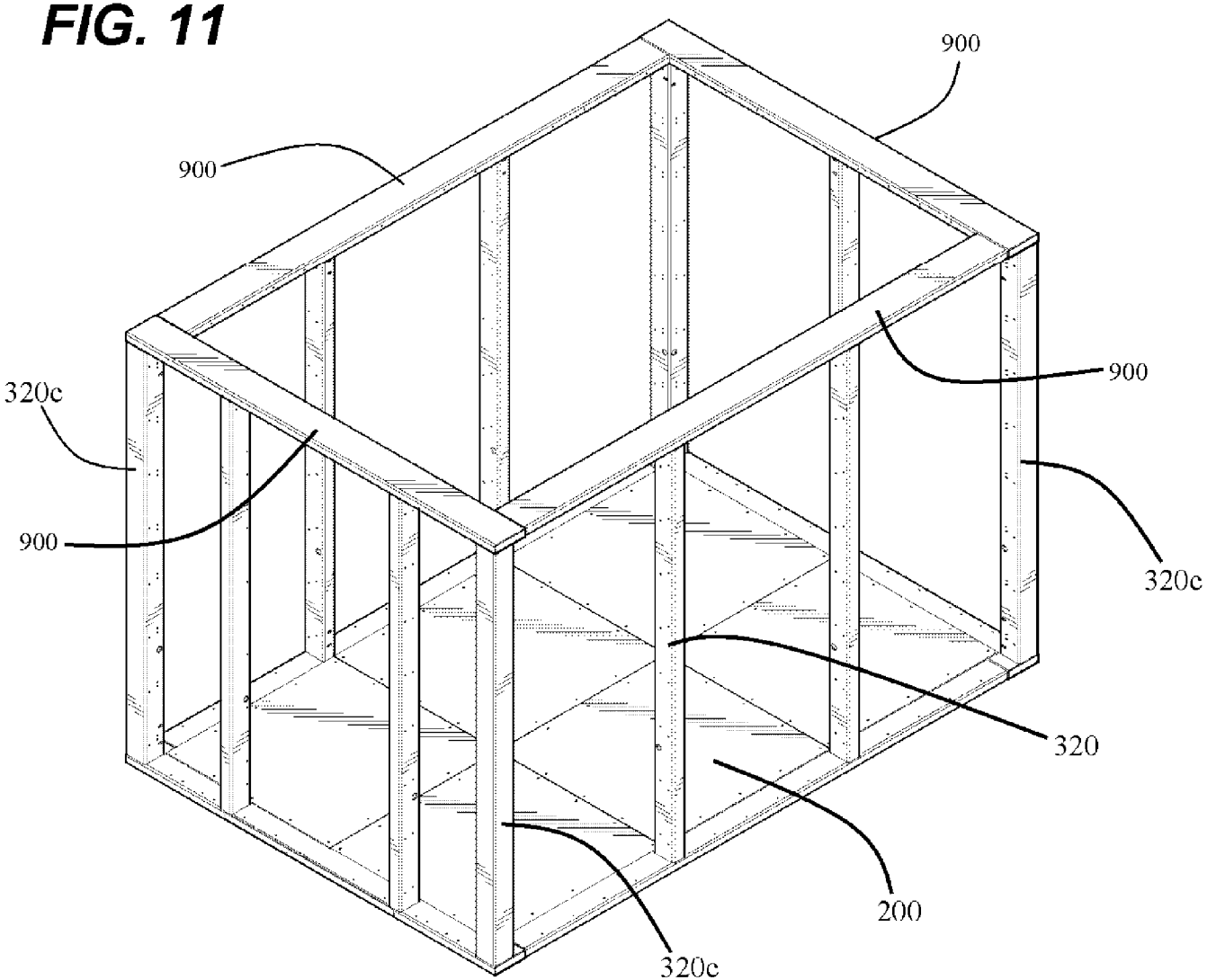
FIG. 11 shows the plurality of perimeter ceiling sill sections of FIG. 10 in place.
Figure 12:
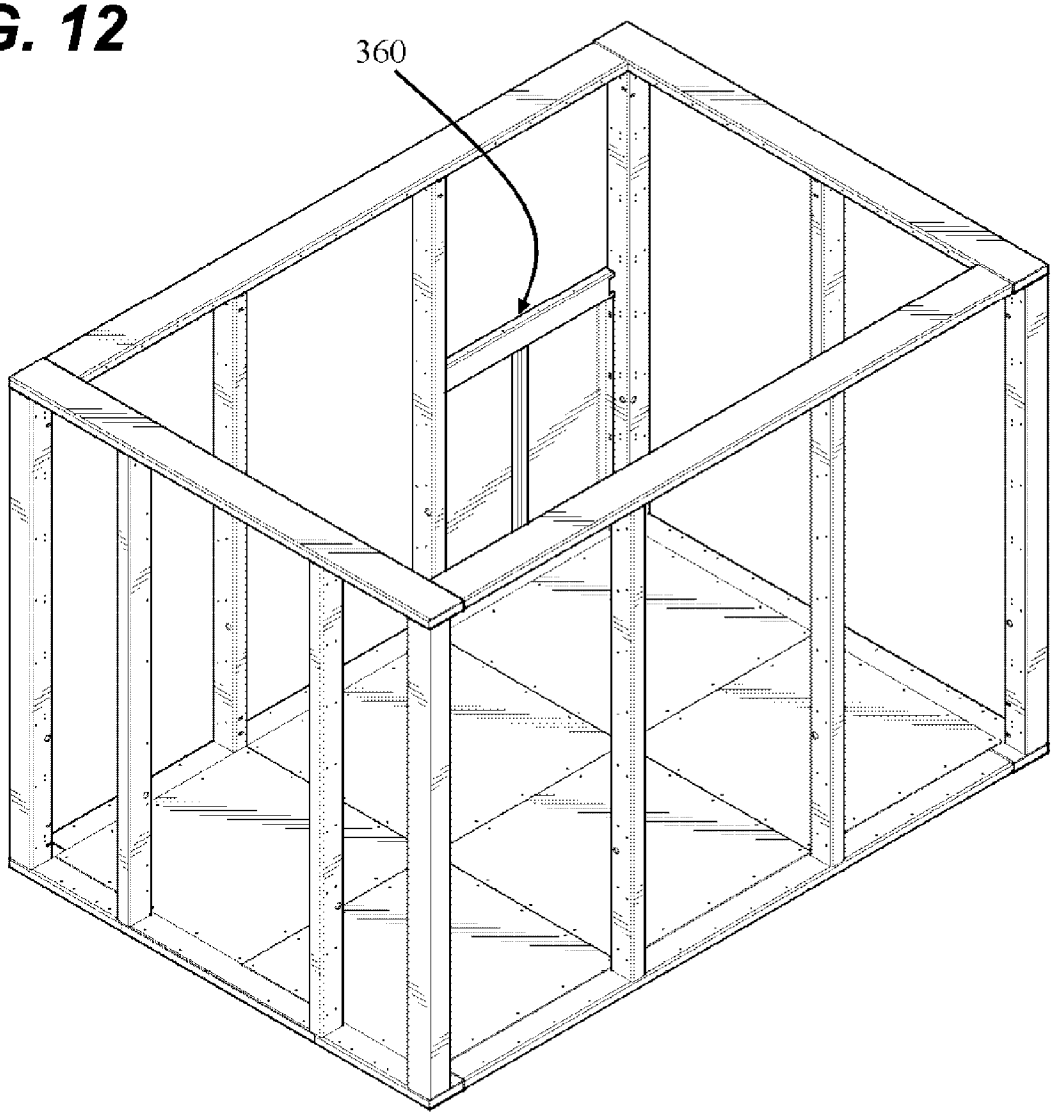
FIG. 12 shows a lower outer panel fitted to the partially completed ballistic and forced entry room of FIG. 11.
Figure 13:
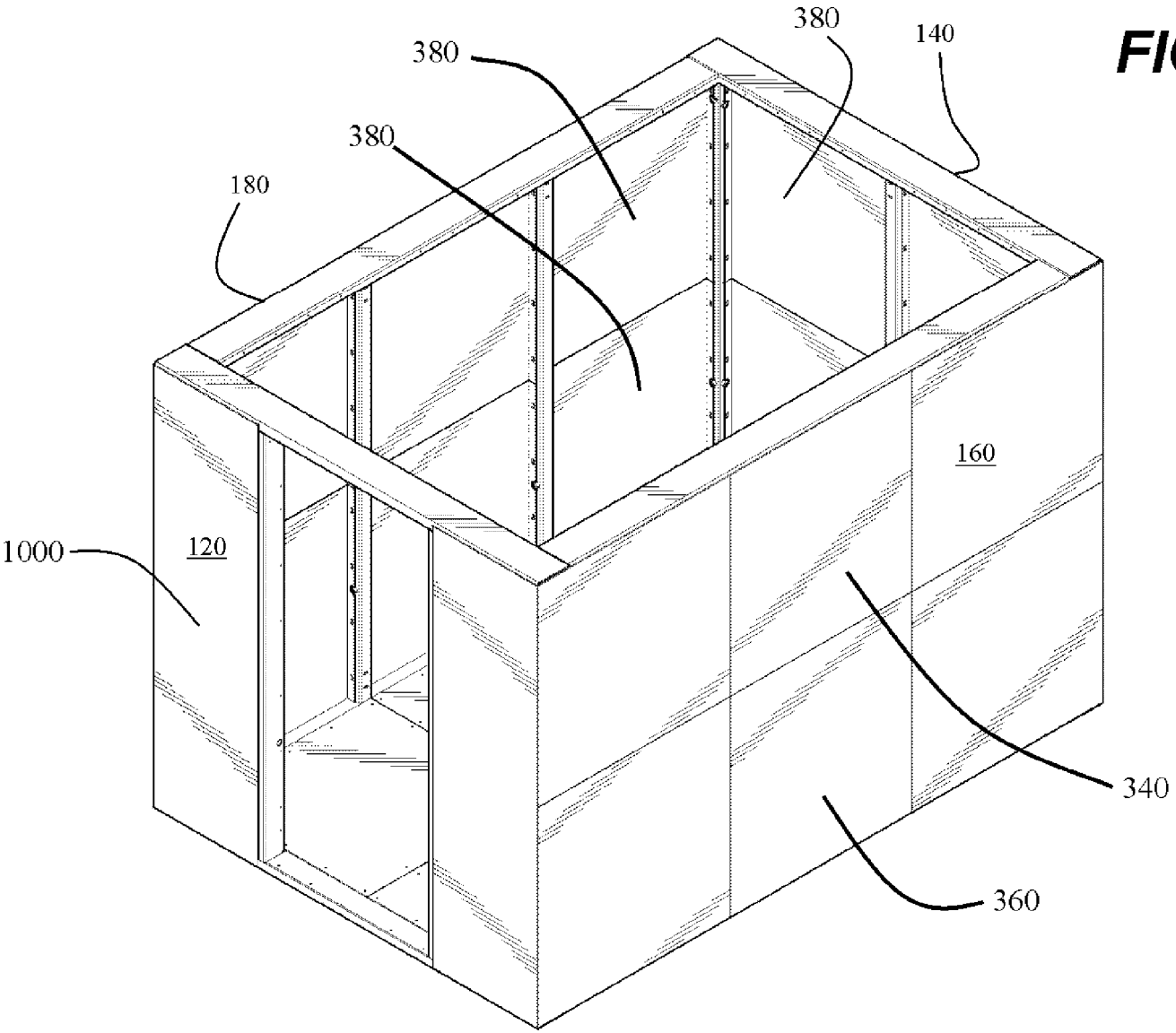
FIG. 13 shows a partially completed room with the front, rear, and sidewalls fitted with outer and inner panels according to the present invention.
Figure 14A:
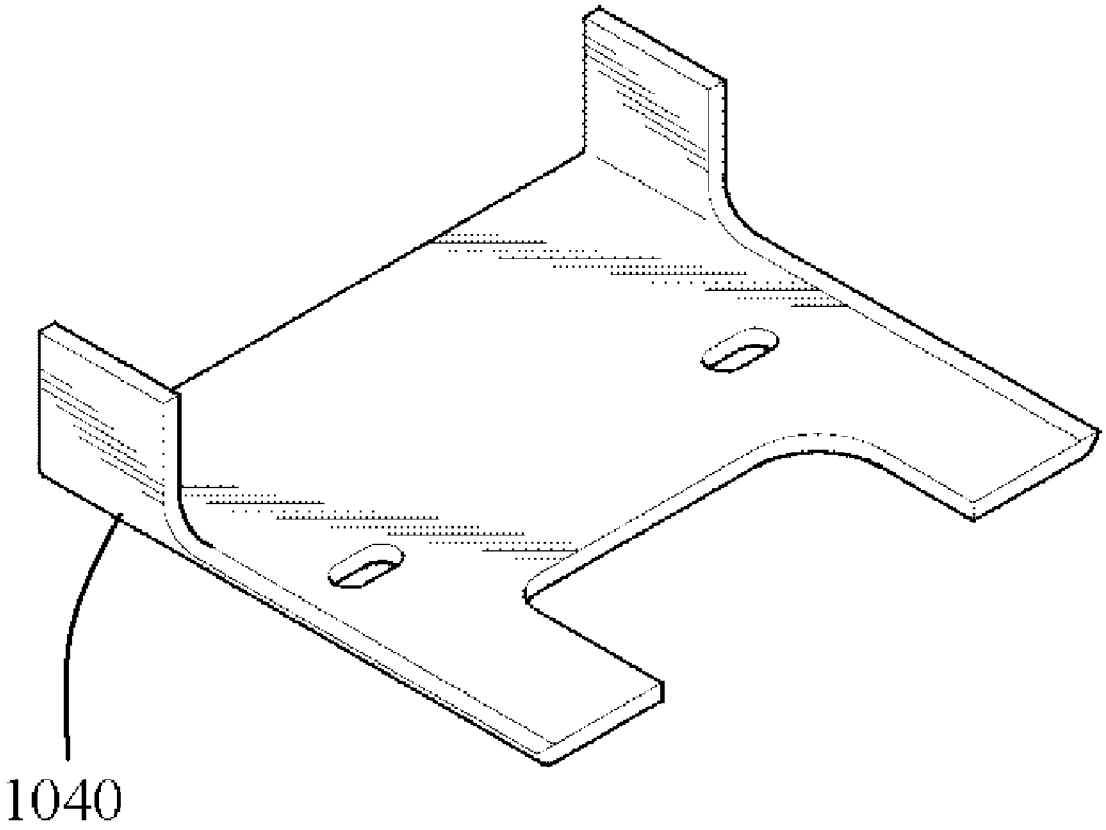
FIG. 14A shows a temporary support according to the present invention.
Figure 14B:
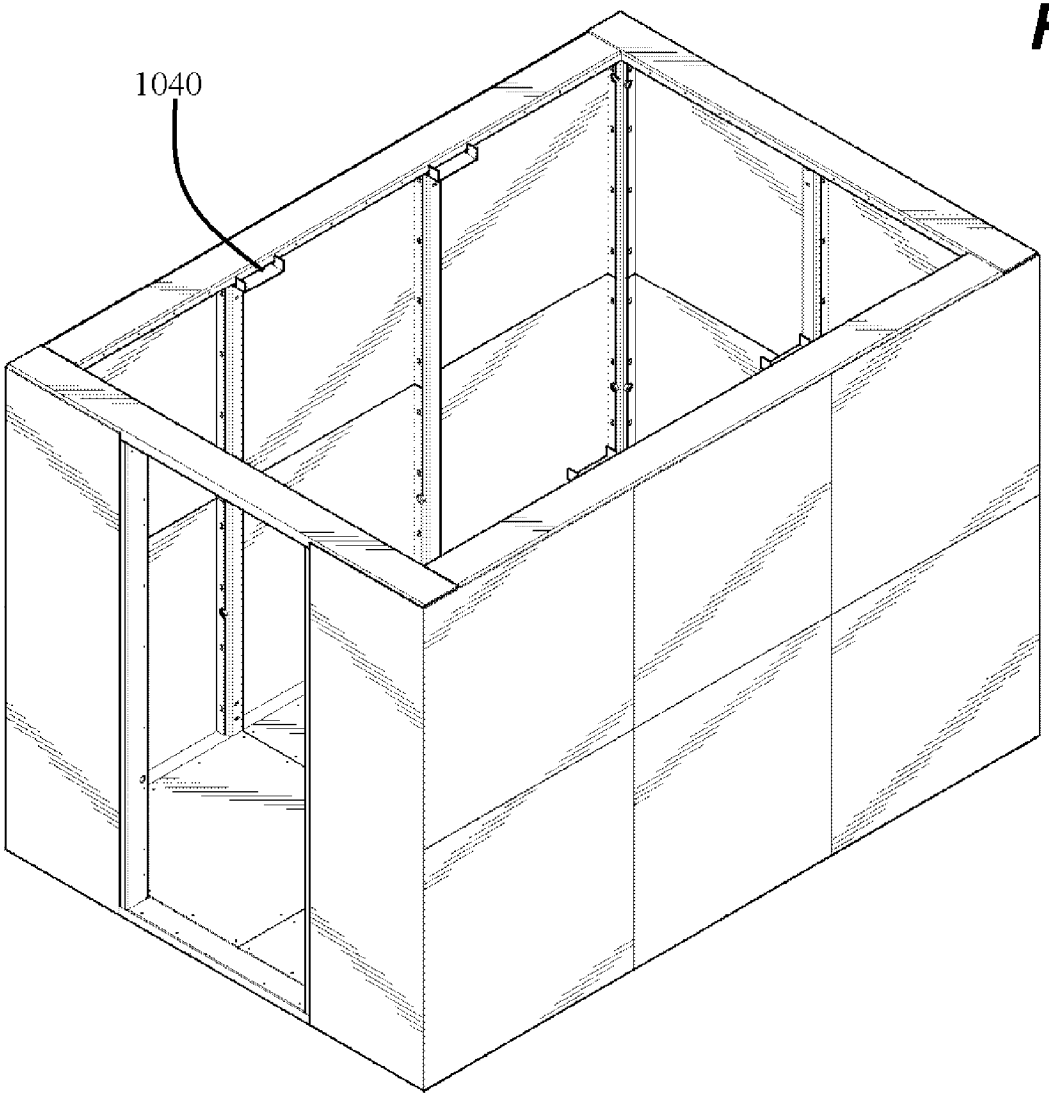
FIG. 14B shows the partially completed room of FIG. 13 in combination with at least one temporary support.
Figure 15:
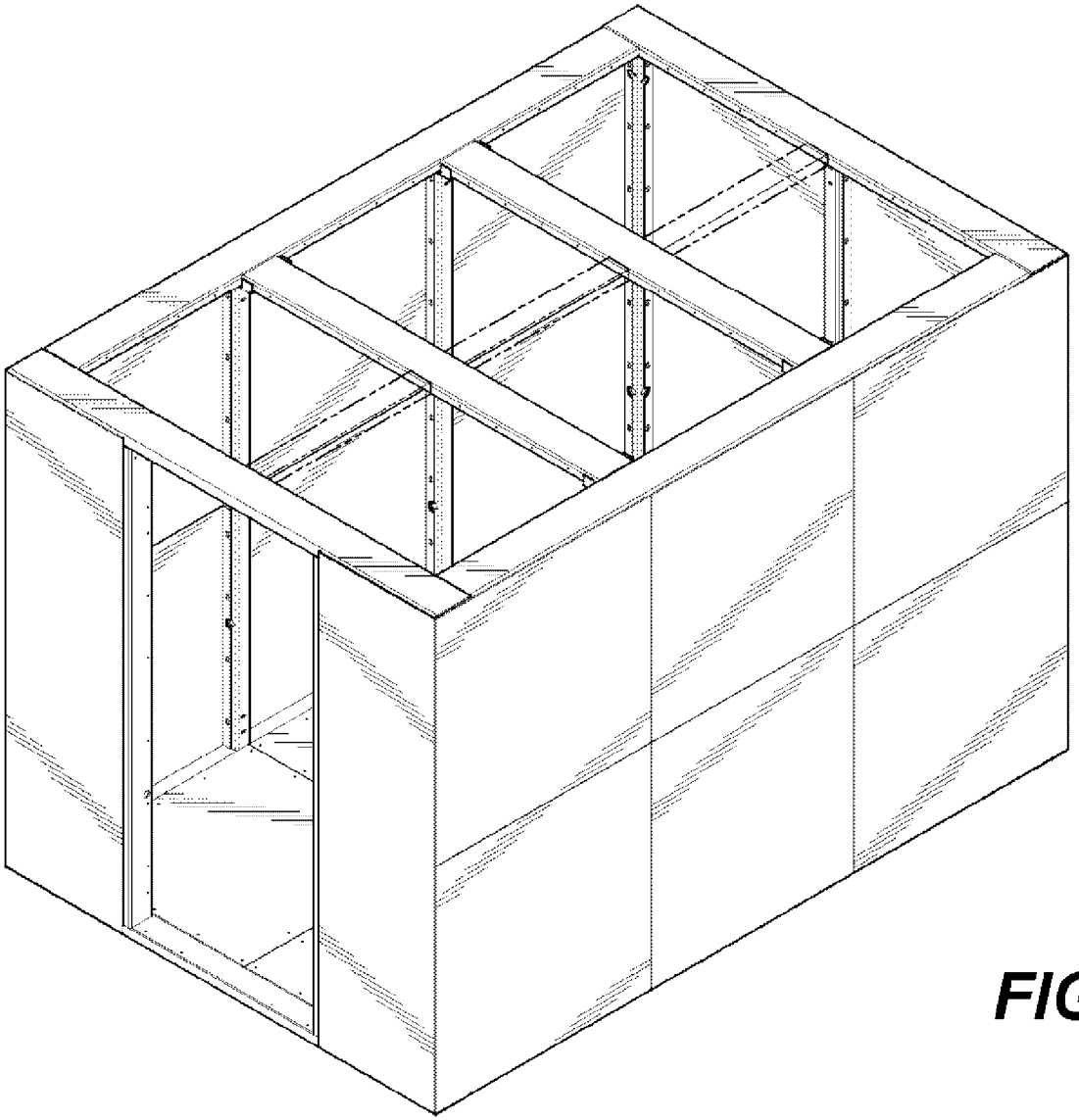
FIGS. 15 and 16 show the completion of the ceiling of the ballistic and forced entry resistant room according to the present invention.
Figure 16:
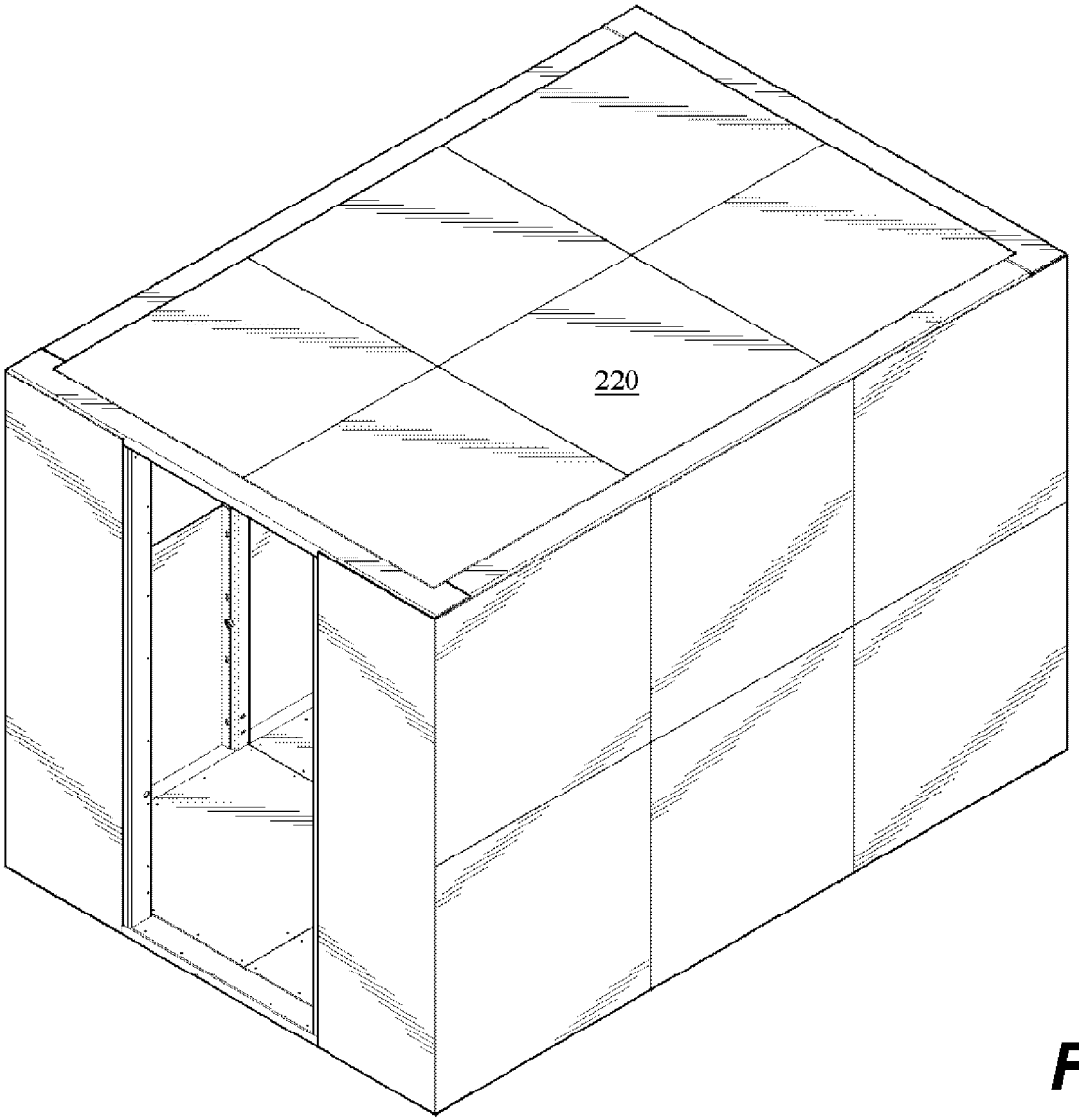
Figure 17:
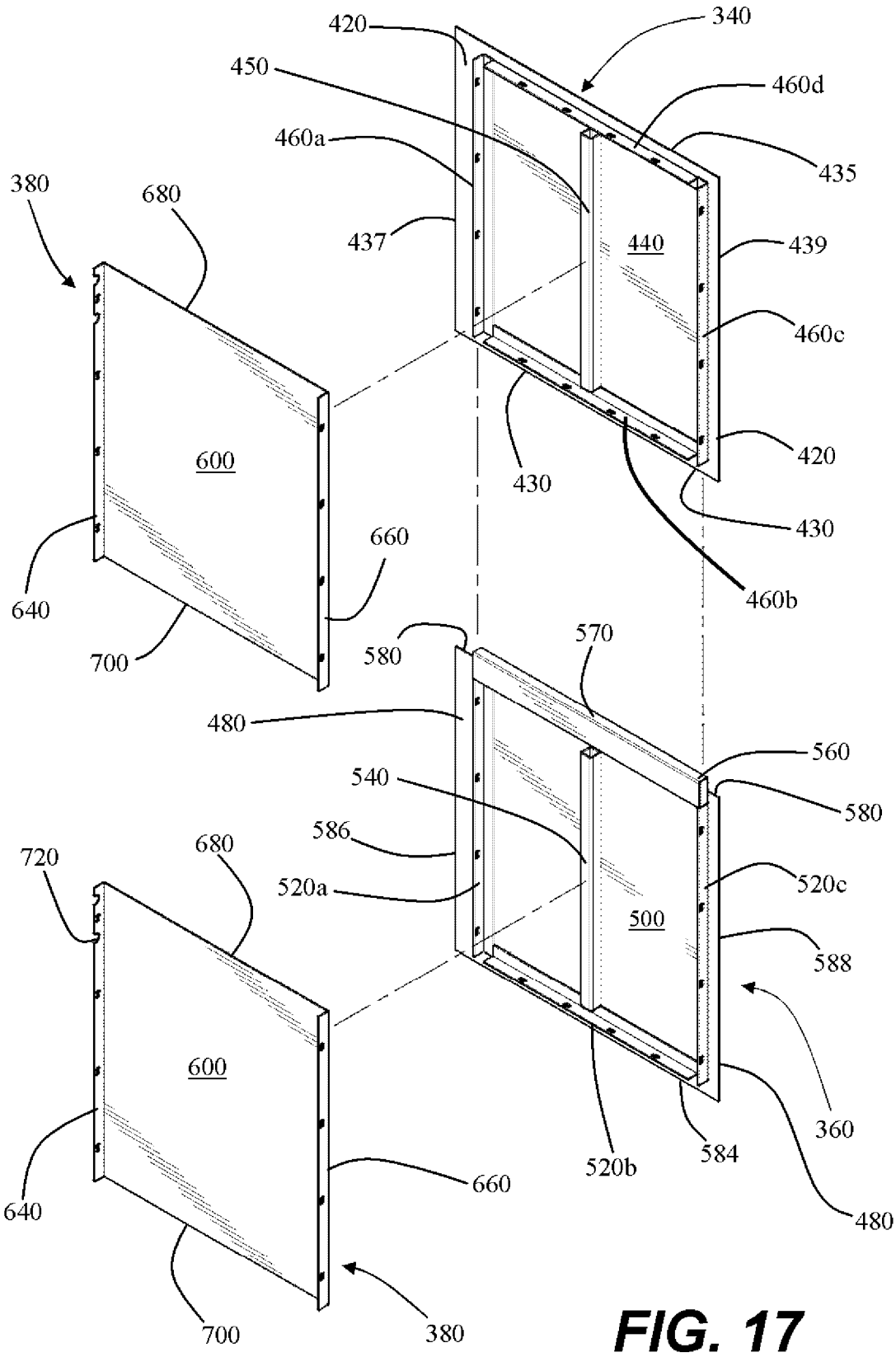
FIGS. 17 and 18 show the upper and lower outer panels and inner wall panels that make up the sidewalls of the ballistic and forced entry resistant room according to the present invention.
Figure 18:
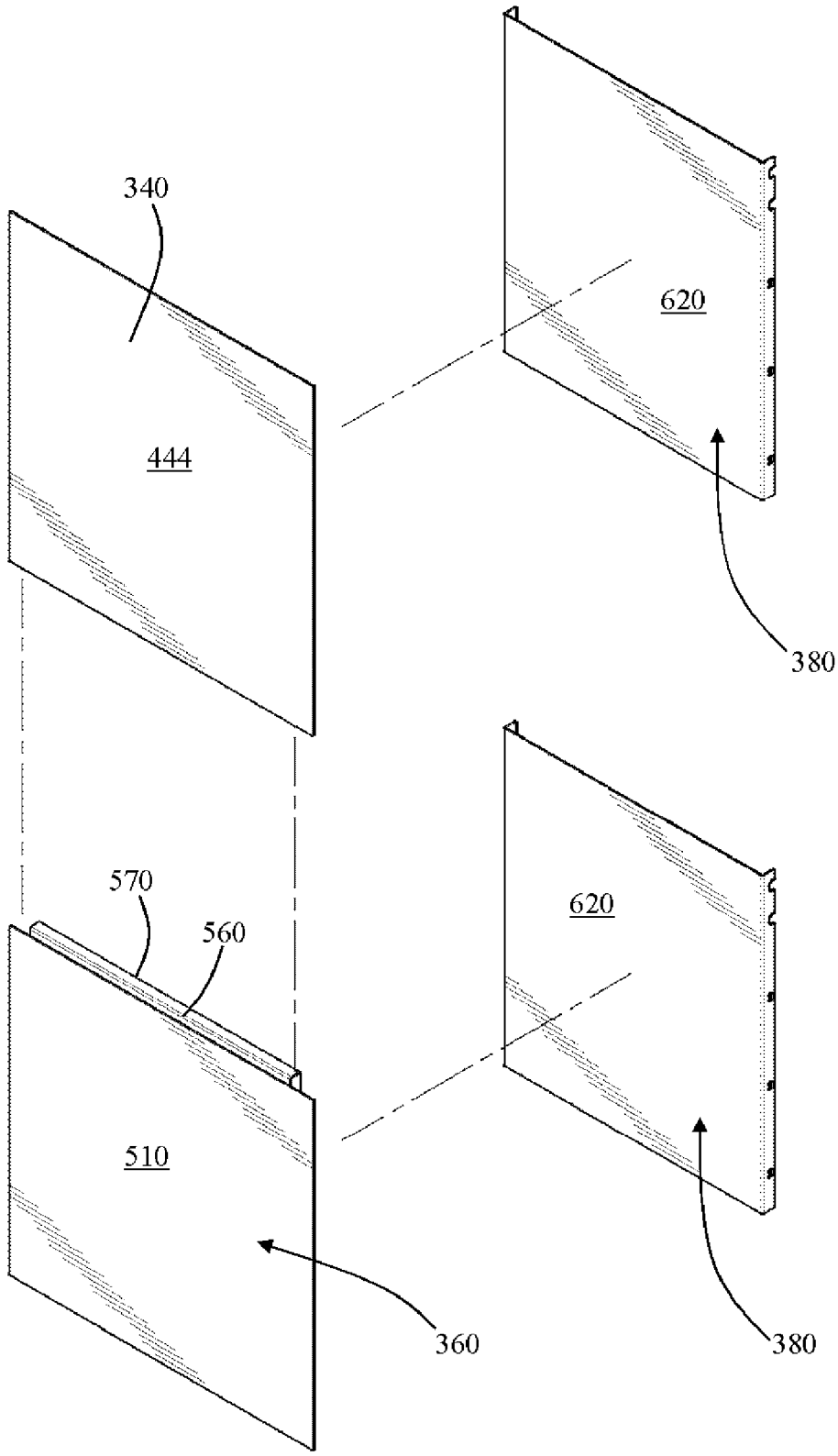
Figure 19:
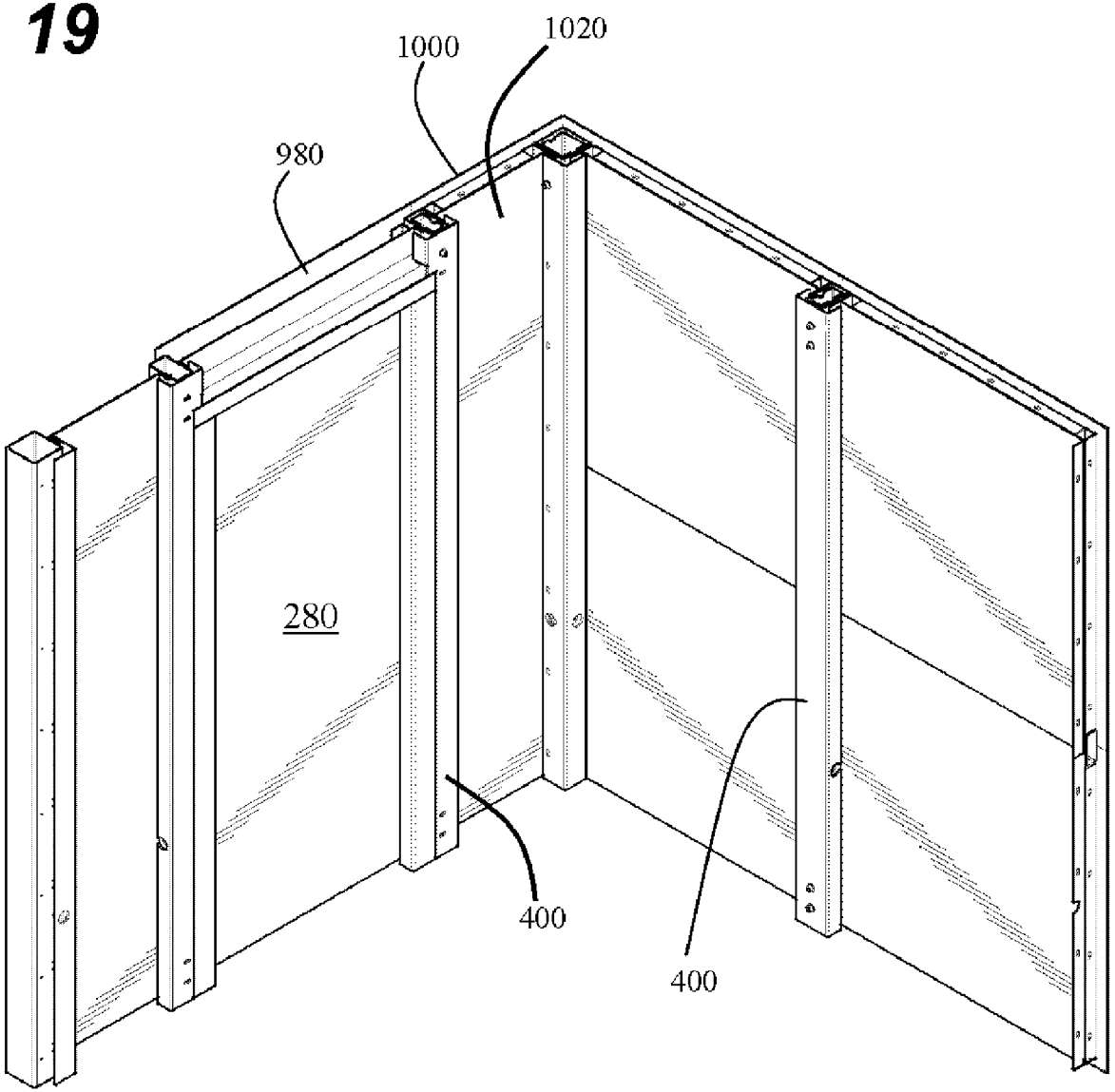
FIG. 19 shows a partial internal view of the ballistic and forced entry resistant room according of FIG. 1.
Figure 20:
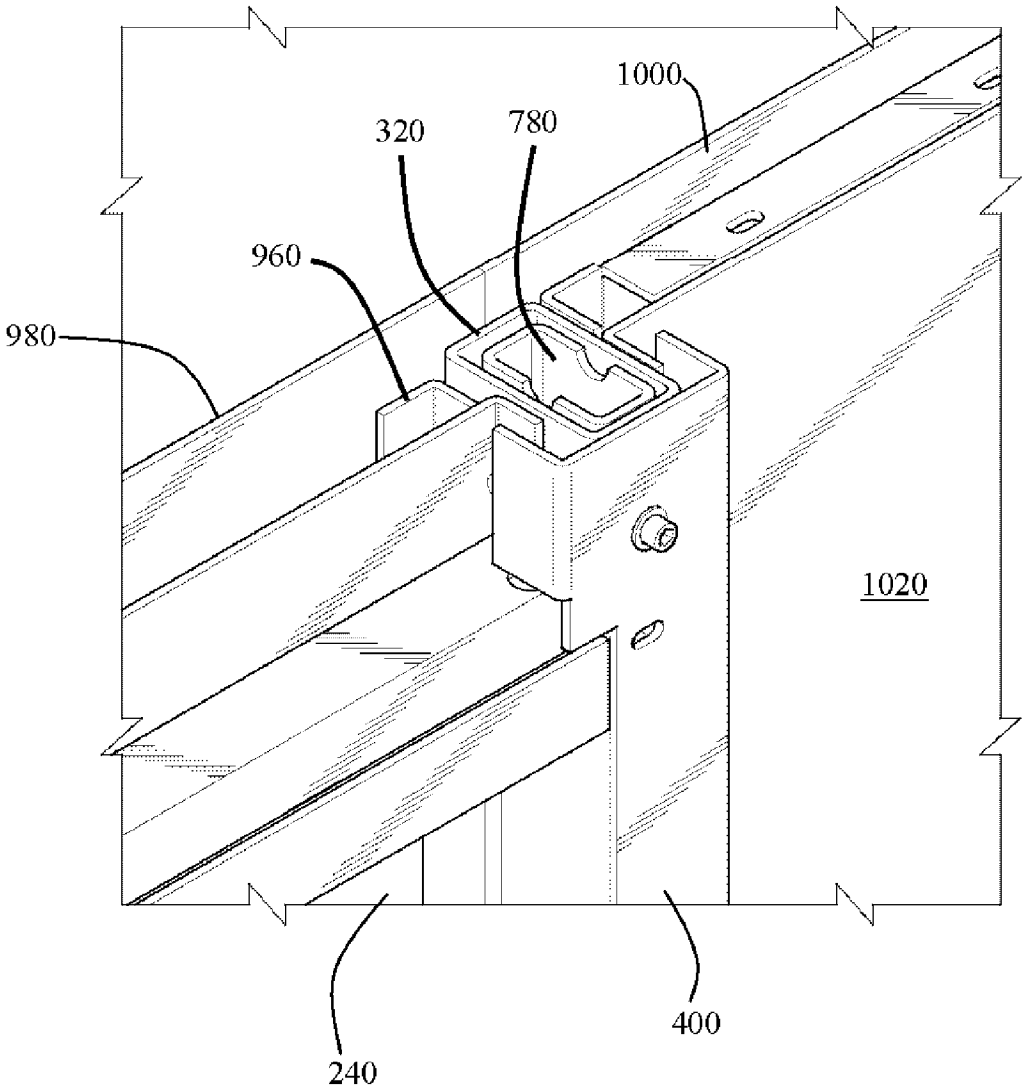
FIG. 20 shows a cut away view of the top of a vertical support column proximate to a doorway.
Figure 21:
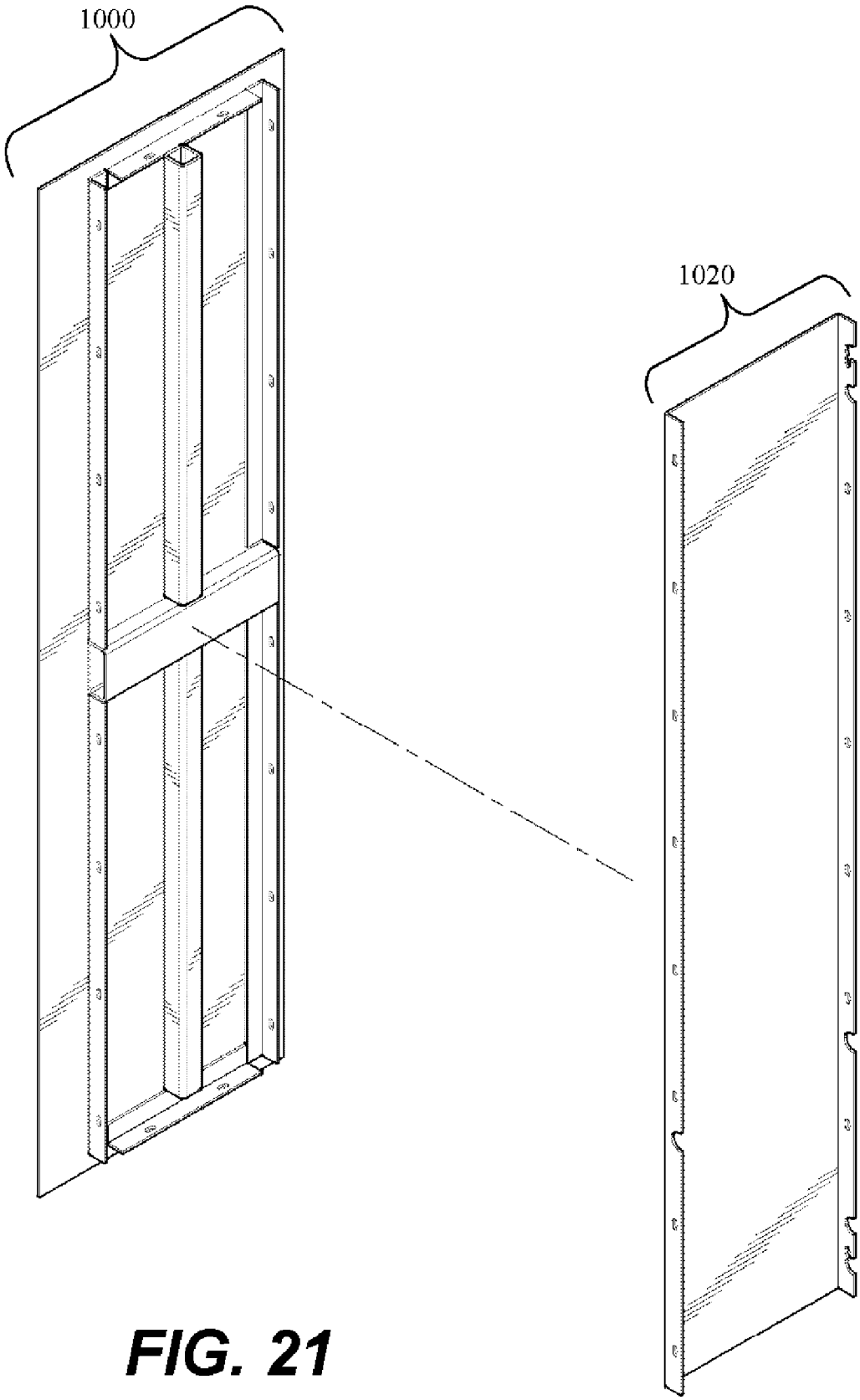
FIG. 21 shows the outer and inner panels that make up the front end of the ballistic and forced entry resistant room according of FIG. 1.
Figure 22:
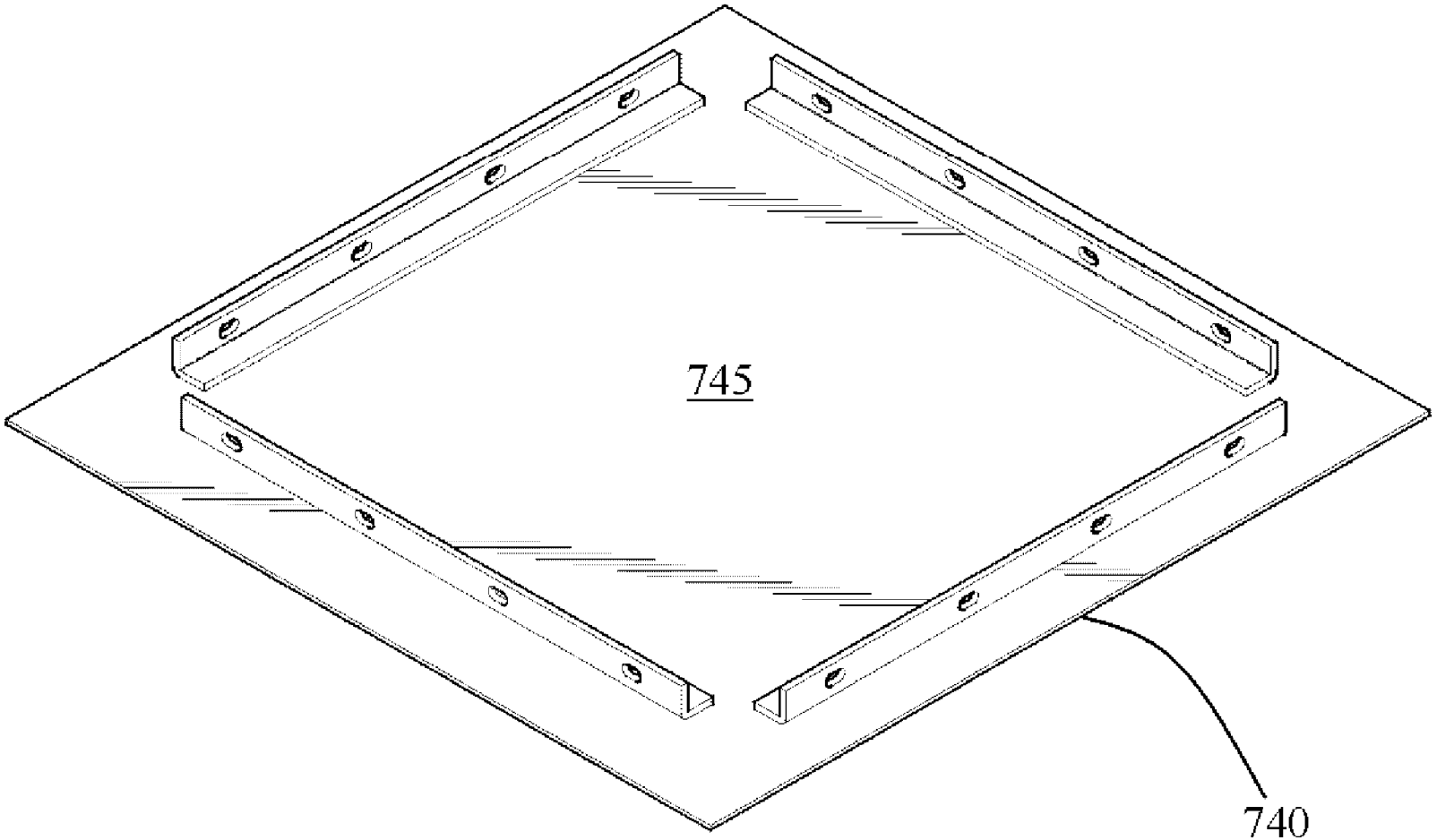
FIGS. 22 and 23 show bottom and top perspective views of a bottom floor panel.
Figure 23:
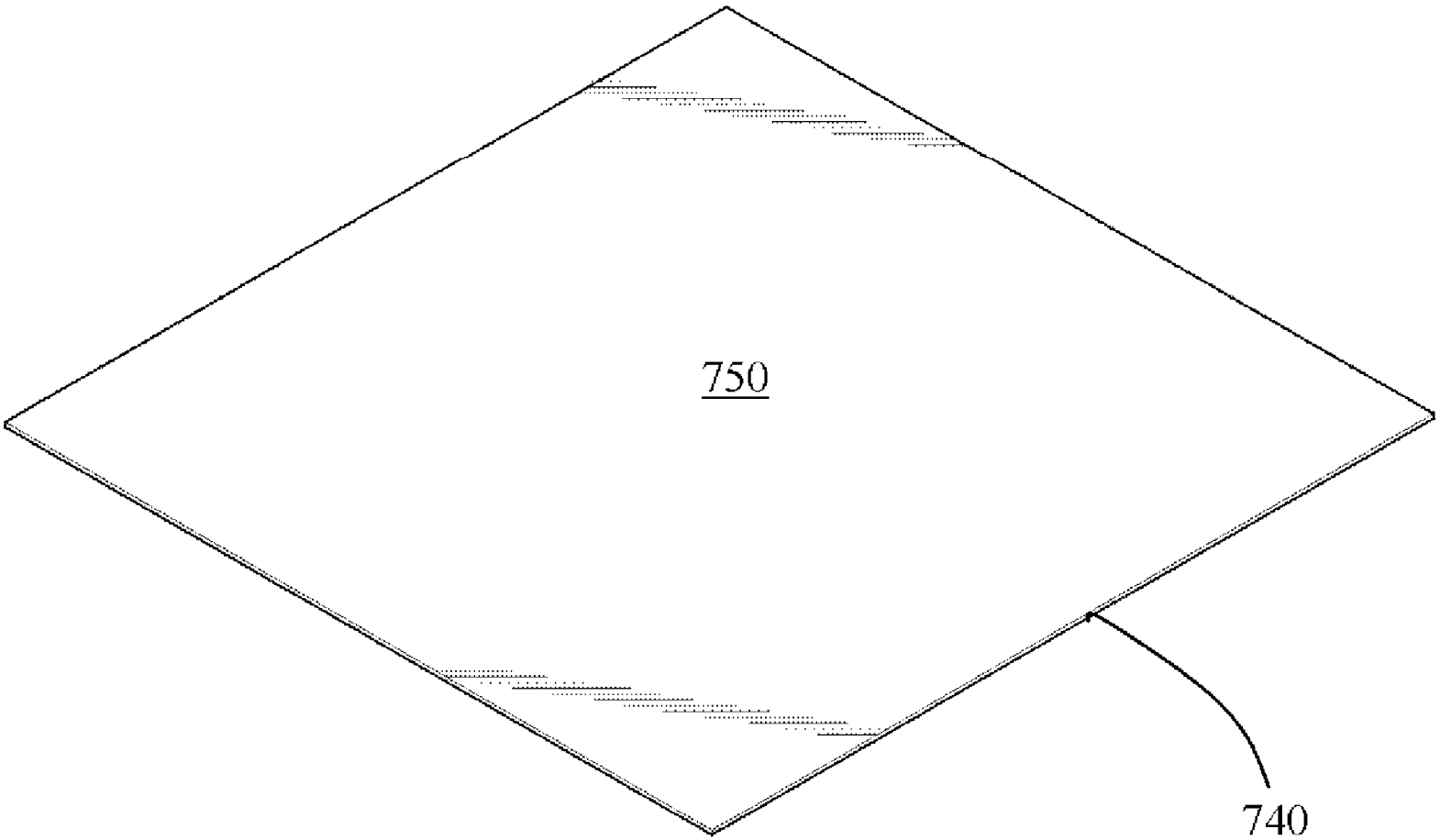

FIG. 2 shows a plurality of bottom floor panels 740 laid out to form the outermost layer of the floor 200. As will be seen, there is no requirement to weld the bottom floor panels 740 to each other. In FIG. 2 the bottom floor panels are labeled as follows: 740*a* 740*b* . . . 740*f*.

A plurality of perimeter floor sill sections 760 are used to construct the floor 200. Each floor sill section 760 defines an upper surface 770, and comprises a rectangular tube section of predetermined length with a plurality of bottom internal sleeves 780 protruding at a perpendicular angle from the upper surface 770 of the perimeter floor sill sections 760 at predetermined locations. The internal sleeves 780 can include bottom corner internal sleeves 780*c*.

The perimeter sill sections 760 are optionally anchored to a suitable base such as, but not limited to a concrete slab CS with respect to outside-construction or flooring inside, for example an embassy building or any building in which a room or refuge is desired that is resistant to forced entry and ballistic impacts. The perimeter sill sections 760 define an inner side surface 800. The inner side surface 800 is attached to the outer L-brackets of the bottom floor panels 740.

Short floor sections 820 and transverse floor sections 840 are used to join the bottom floor panels 740. Fasteners such as self tapping screws are used to fasten the short and transverse sections 820 and 840 to the remaining L-brackets of the bottom floor panels 740. Floor sheets 860 are laid on top of the short and transverse sections 820 and 840 and fastened thereto using, for example, self tapping screws. The short and transverse sections 820 and 840 preferably have rectangular cross-sections and are made out of metal such as 0.25" American steel. The floor sheets 860 are preferably four sided rectangular sheets of metal such as 0.25" American steel sheets.

Vertical support columns 320 are fitted over and attached to bottom internal sleeves 780. The vertical support columns 320 are attached to bottom internal sleeves 780 using fasteners 880 such as, but not limited to, bolts or self-tapping screws. The vertical support columns include corner vertical support columns 320*c*.

The ceiling 220 is substantially a mirror image of the floor 200, i.e., the ceiling 220 is an upside down version of the floor 200. A plurality of perimeter ceiling sill sections 900 are used to construct the ceiling 220. Each ceiling sill section 900 defines a lower surface 920, and comprises a rectangular tube section of predetermined length with a plurality of top internal sleeves 940 protruding at a perpendicular angle from the lower surface 920 of the perimeter ceiling sill sections 900 at predetermined locations. The top internal sleeves 940 can include top corner internal sleeves 940*c*. "Top" signified the sleeve is proximate to ceiling level.

The present invention provides remarkable resistance to forced entry. An attacker using a crowbar or similar implement who attempts to pry or peel apart plates 420 (represented by alpha-numeric labels 420*a* and 420*b*) of adjacent upper outer panels 340 (represented by alpha-numeric labels 340*a* and 340*b*) would unexpectedly find it very difficult to peel back adjacent plates 420*a* and 420*b* beyond L-brackets 460*c* and 460*a*.

Figure 24:
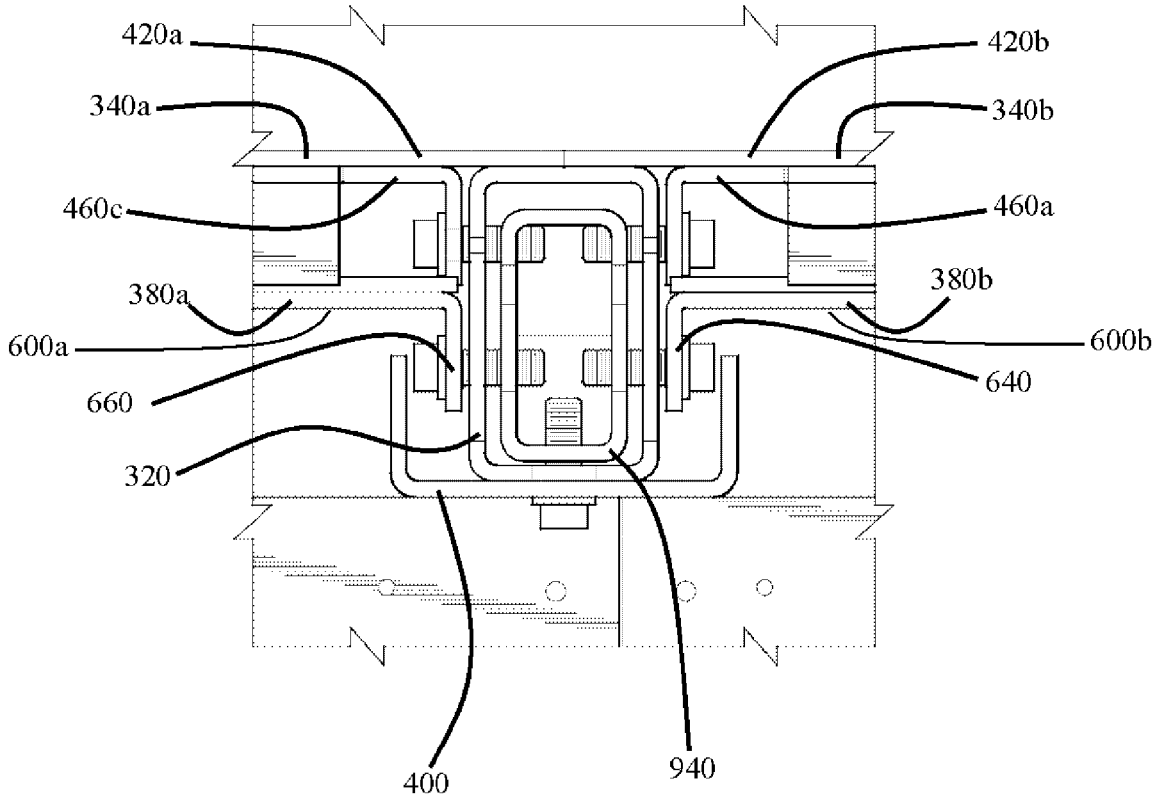
FIG. 24 shows a cut-away view of a vertical support column proximate to ceiling level.

Resistance to peel-back is achieved by the way the outer and inner panels 340 and 360 are attached to the vertical support columns 320. For example, as shown in the section view of FIG. 24, adjacent outer panels 340 (represented by alpha-numeric labels 340*a* and 340*b*) and adjacent inner wall panels 380 (represented by alpha-numeric labels 380*a* and 380*b*) are bolted to a vertical support column 320 and top internal sleeve 940. More specifically, L-brackets 460*c* and 460*a* of adjacent upper outer panels 340*a* and 340*b* are fastened to the vertical support column 320 and top internal sleeve 940 by means of, for example, self-tapping screws. Vertical sides 640 and 660 of adjacent inner wall panels 380*a* and 380*b* are fastened to the vertical support column 320 and top internal sleeve 940. The top internal sleeve 940 is so named because it is located inside vertical support column 320 at ceiling level 220.

Figure 25:
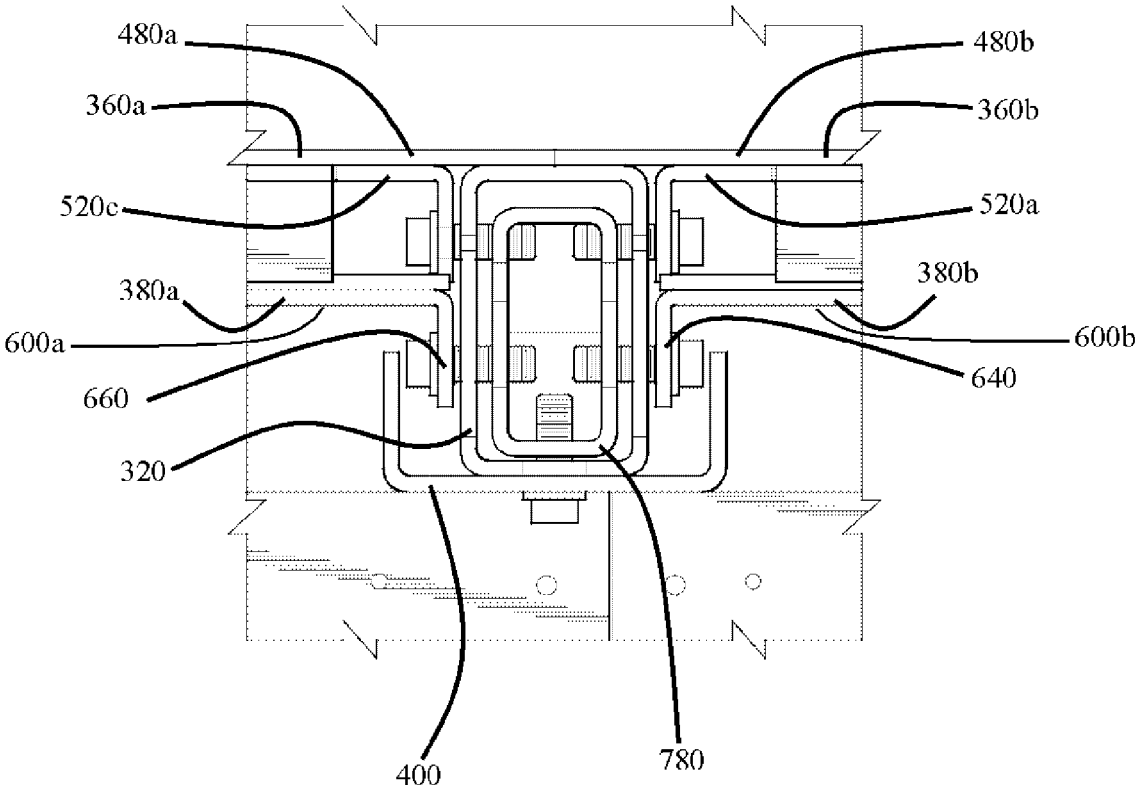
FIG. 25 shows a cut-away view of a vertical support column proximate to floor level.
Figure 26:
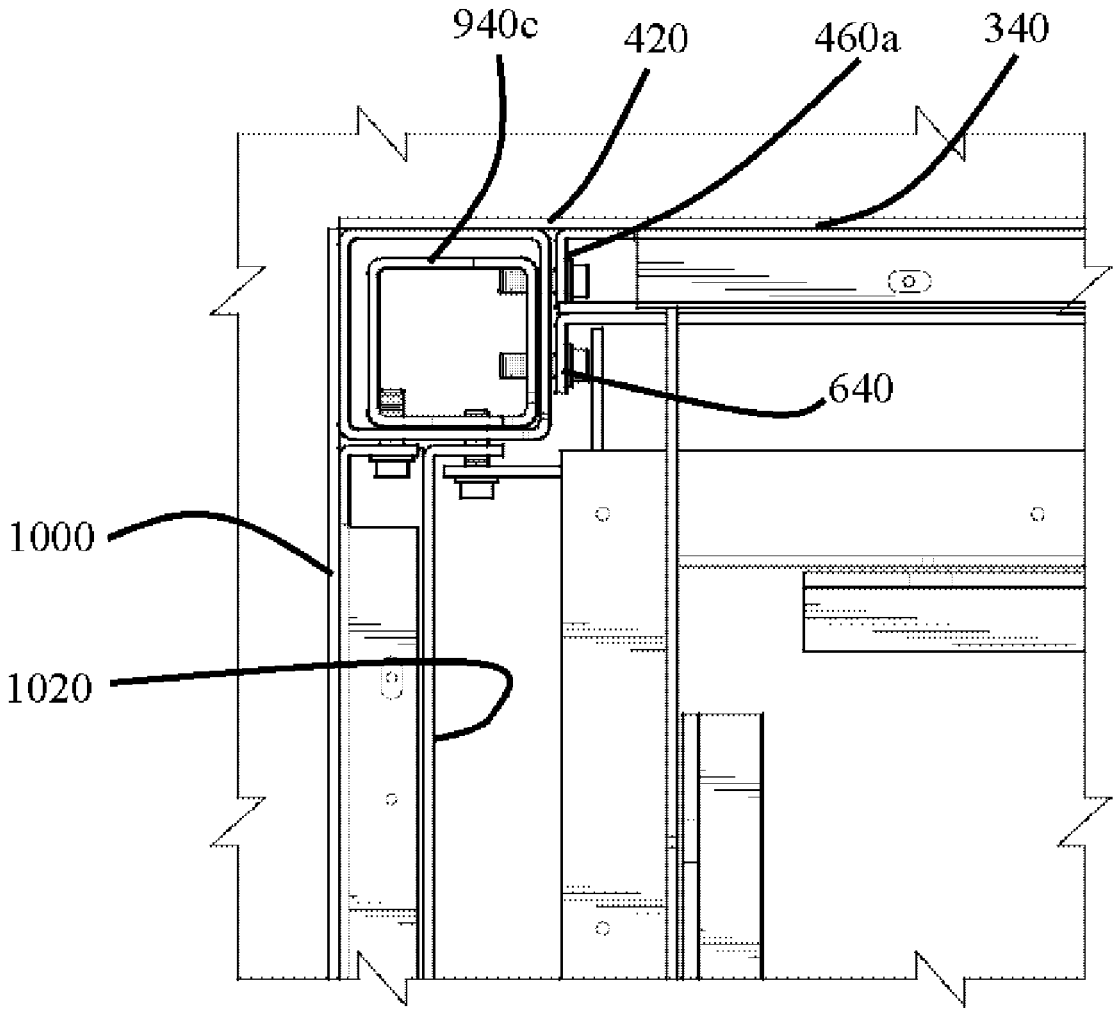
FIG. 26 shows a cut-away view of a corner vertical support column proximate to ceiling level.
Figure 27:
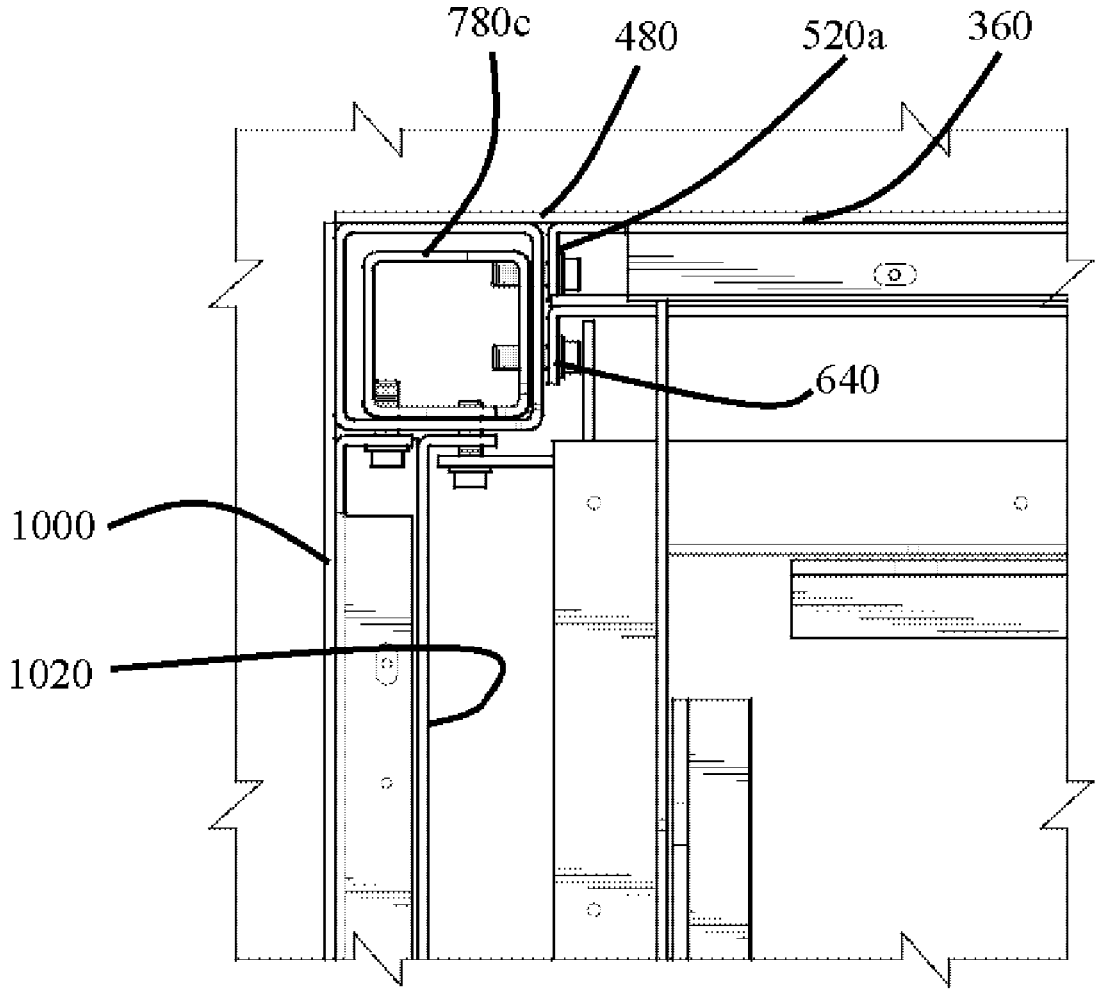
FIG. 27 shows a cut-away view of a corner vertical support column proximate to floor level.

With respect to FIG. 25, an attacker using a crowbar or similar implement who attempts to pry or peel apart plates 480 (represented by alpha-numeric labels 480*a* and 480*b*) of adjacent lower outer panels 360 (represented by alpha-numeric labels 360*a* and 360*b*) would unexpectedly find it very difficult to peel back adjacent plates 480*a* and 480*b* beyond L-brackets 460*c* and 460*a*. More specifically, L-brackets 520*c* and 520*a* of adjacent lower outer panels 360*a* and 360*b* are fastened to the vertical support column 320 and bottom internal sleeve 780 by means of, for example, self-tapping screws. Vertical sides 640 and 660 of adjacent inner wall panels 380*a* and 380*b* are fastened to the vertical support column 320 and bottom internal sleeve 780. The bottom internal sleeve 940 is so named because it is located inside vertical support column 320 at ceiling level 220.

A ballistic stop 400 is employed for added protection against ballistic projectiles such as bullets. The ballistic stop 400 can be U-shaped member, and extends along the inner side of vertical support column 320 between the floor 200 and ceiling 220, and is fastened to the inner sides of vertical support column 320 and bottom internal sleeve 780.

It should be understood that the components used in the present invention can have modified shape. For example, the ballistic stop 400 can be an L-bracket of 0.25" steel or have U-shaped cross-section, but serves the same purpose of preventing incursions of ballistic fragments or bullets into the interior of room 100.

With respect to top internal sleeve 940, an attacker using a crowbar or similar implement who attempts to pry or peel apart plates 480 (represented by alpha-numeric labels 480*a* and 480*b*) of adjacent lower outer panels 360 (represented by alpha-numeric labels 360*a* and 360*b* would unexpectedly find it very difficult to peel back adjacent plates 480*a* and 480*b* beyond L-brackets 520*c* and 520*a*.

It should be understood that the L-brackets can be of varying length and still retain the anti-peel property of the present invention. For example, a short length L-bracket 960 can be welded to the inside surface of an over-door outer panel 980 located above a door 280, and the short length L-bracket 960 bolted to a bottom internal sleeve 780 and vertical support column 320. The terms "short length L-bracket" and "angle" are regarded as equivalent terms.

The outer and inner panels can have any predetermined overall shape so long as the anti-peel property is retained. For example, the front end 120 comprises outer and inner panels 1000 and 1020. The outer and inner panels 1000 and 1020 are elongated and narrower than the inner and outer panels of the sidewalls 160 and 180. A temporary support 1040 can be used to help assemble the room 100.

It is to be understood that the present invention is not limited to the embodiments described above, but encompasses any and all embodiments within the scope of the following claims.

What is claimed is:

1. A sidewall of a ballistic and forced entry resistant construction, comprising:

a plurality of vertical support columns (320) each having opposite ends, an outer side, an inner side, and a width, wherein a ballistic stop (400) is fastened to the inner side of vertical support column (320);

at least one perimeter floor sill section (760) having an upper surface (770);

at least one perimeter ceiling sill section (900) having a lower surface (920);

a plurality of bottom internal sleeves (780) at spaced intervals extending upward for a distance from the upper surface (770) of perimeter floor sill section (760);

a plurality of top internal sleeves (940) at spaced intervals extending downward for a distance from the lower surface (920) of perimeter ceiling sill section (900);

a plurality of upper outer panels (340) each having a four sided upper plate (420), wherein upper plate (420) comprises a bottom edge (430), a top edge (435), opposite vertical edges (437 and 439), interior and exterior faces (440 and 444), wherein the interior face (440) of upper plate (420) is fitted with four L-shaped brackets (460*b*, 460*d*, 460*a* and 460*c*) which are respectively located parallel to, but offset by a gap of predetermined width from bottom edge (430), top edge (435), and opposite vertical edges (437 and 439), wherein the predetermined gap at the opposite vertical edges (437 and 439) of the upper outer plate (420) corresponds to half the width of the vertical support columns (320);

a plurality of lower outer panels (360) each having a four sided lower plate (480), wherein lower plate (480) comprises a top edge (580), a bottom edge (584), opposite vertical edges (586 and 588), interior and exterior faces (500 and 510), wherein the interior face (500) of lower plate (480) is fitted with three L-shaped brackets (520*a*, 520*b*, and 520*c*) which are respectively located parallel to, but offset by a gap of predetermined width from the bottom edge (584), top edge (580), and opposite vertical edges (586 and 588), wherein the predetermined gap at the opposite vertical edges (586 and 588) of the lower outer panel (360) corresponds to half the width of the vertical support columns (320); and a plurality of inner wall panels (380) each defining an inner face (600) and an outer face (620), first and second opposite facing vertical sides (640 and 660), a top edge (680) and a bottom edge (700), wherein each of the vertical sides (640 and 660) are bent lengthwise and inwards at a perpendicular angle from the inner face (600) such that the vertical sides (640 and 660) point away from the upper and lower outer panels (340 and 360), a series of drilled holes are located at predetermined points along each of the vertical sides (640 and 660), the vertical sides (640 and 660) are attached by means of fasteners without welding to adjacent vertical support columns (320), wherein a connecting tube (560) is attached to the interior face (500) of each lower plate (480) in such a manner that the connecting tube (560) overlaps and extends along a predetermined length of the top edge (580) of lower plate (480), wherein each connecting tube (560) defines a top side (570), wherein the sidewall the top side (570) is secured to the second L-bracket (460*b*) of upper outer panel (340) thereby securing the upper and lower outer panels (340 and 360) to each other with bottom edge (430) of upper plate (420) and top horizontal edge (580) of lower plate (480) abutting against each other, wherein the opposite ends of the vertical columns (320) are located between the bottom and top internal sleeves (780 and 940) such that the sleeves fit inside the opposite ends of vertical columns (320), and wherein each upper outer panel (340) is located between adjacent vertical support columns (320) and vertical L-shaped brackets (460*a*, 460*c*) of upper outer panel (340) are attached by means of fasteners without welding to adjacent vertical columns (320), and each lower outer panel (360) is located between adjacent vertical columns (320) and vertical L-shaped brackets (520*a*, and 520*c*) of lower outer panel (360) are affixed to adjacent vertical support columns (320) such that upper and lower plates (420 and 480) of upper and lower outer panels (340 and 360) abut against the outer side of the vertical support column (320), and while resistant to peel-back, in the event of peel-back, the ballistic stop (400) prevents forced entry.

* * * * *